US008096818B2

(12) United States Patent
Arenas et al.

(10) Patent No.: US 8,096,818 B2
(45) Date of Patent: Jan. 17, 2012

(54) MODULAR WIRING SYSTEM WITH LOCKING ELEMENTS

(75) Inventors: Alfredo Arenas, Little Neck, NY (US); Leslie Lindenstraus, New York, NY (US); Anthony Tufano, North Massapequa, NY (US); Dennis Oddsen, Eaton's Neck, NY (US); John Eder, Floral Park, NY (US); Christopher Rafferty, Brooklyn, NY (US)

(73) Assignee: Leviton Manufacturing Company, Inc., Melville, NY (US)

( * ) Notice: Subject to any disclaimer, the term of this patent is extended or adjusted under 35 U.S.C. 154(b) by 0 days.

(21) Appl. No.: 12/689,163

(22) Filed: Jan. 18, 2010

(65) Prior Publication Data

US 2010/0120274 A1 May 13, 2010

Related U.S. Application Data

(63) Continuation of application No. 12/040,648, filed on Feb. 29, 2008, now Pat. No. 7,666,010, which is a continuation-in-part of application No. 11/553,793, filed on Oct. 27, 2006, now Pat. No. 7,357,652.

(51) Int. Cl.
*H01R 4/66* (2006.01)

(52) U.S. Cl. ..... 439/107

(58) Field of Classification Search ..... 439/107, 439/337, 135, 332, 535, 673, 674
See application file for complete search history.

(56) References Cited

U.S. PATENT DOCUMENTS

| | | | |
|---|---|---|---|
| 1,938,309 | A | 12/1933 | Williams |
| 1,938,917 | A | 12/1933 | Loetscher |
| 2,238,386 | A | 4/1941 | Louis |
| 2,466,930 | A | 6/1944 | Cook |
| 2,397,688 | A | 4/1946 | Osinski |
| 2,399,688 | A | 5/1946 | Metzner et al. |
| 2,433,917 | A | 1/1948 | McCartney |
| 2,515,256 | A | 7/1950 | O'Brien et al. |
| 2,763,847 | A | 1/1952 | Hubble |
| 2,644,144 | A | 6/1953 | Richardson |
| 2,892,174 | A | 2/1957 | Benander |
| 2,937,688 | A | 5/1960 | Kirchner |

(Continued)

FOREIGN PATENT DOCUMENTS

CA 1182583 2/1985

(Continued)

OTHER PUBLICATIONS

International Search Report and the Written Opinion of the International Searching Authority mailed on May 7, 2008 for PCT/2007/082460 filed on Oct. 25, 2007; 15 pages.

(Continued)

*Primary Examiner* — Tulsidas C Patel
*Assistant Examiner* — Vladimir Imas
(74) *Attorney, Agent, or Firm* — Collard & Roe, P.C.

(57) ABSTRACT

A wiring system includes a wiring module and a functional module. The wiring module in at least one embodiment includes elongated holes or openings which are configured to engage or lock with prongs on a functional module to create a lockable connection. The wiring module and the functional module form both a physical and an electrical connection. In another embodiment, there is an adapter which is configured to connect the wiring module and the functional module or unit together.

20 Claims, 18 Drawing Sheets

U.S. PATENT DOCUMENTS

| | | | | | |
|---|---|---|---|---|---|
| 2,941,178 | A | | 6/1960 | Hubble et al. | |
| 2,969,518 | A | | 1/1961 | Miller | |
| 2,985,334 | A | | 5/1961 | Slater | |
| 3,002,175 | A | | 9/1961 | Bertram et al. | |
| 3,023,394 | A | | 2/1962 | Hubbel | |
| 3,038,141 | A | | 6/1962 | Chiuchiolo | |
| 3,120,987 | A | | 2/1964 | Degnan et al. | |
| 3,121,599 | A | * | 2/1964 | Modrey | 439/346 |
| 3,156,761 | A | | 11/1964 | Schinske | |
| 3,233,204 | A | | 2/1966 | Vore, Jr. | |
| 3,390,404 | A | | 6/1968 | Murchison | |
| 3,500,291 | A | | 3/1970 | Hubbell et al. | |
| 3,510,822 | A | | 5/1970 | Patterson | |
| 3,551,880 | A | | 12/1970 | Harwell | |
| 3,609,647 | A | | 9/1971 | Castellano | |
| 3,641,472 | A | | 2/1972 | Phillips, Jr. | |
| 3,685,007 | A | | 8/1972 | Riley et al. | |
| 3,699,499 | A | | 10/1972 | Spaderna | |
| 3,716,651 | A | | 2/1973 | Werner | |
| 3,723,948 | A | | 3/1973 | Wyatt et al. | |
| 3,781,769 | A | * | 12/1973 | Wiley | 439/682 |
| 3,852,513 | A | | 12/1974 | Flahive | |
| 3,858,161 | A | | 12/1974 | Champion et al. | |
| 3,868,161 | A | | 2/1975 | Frantz | |
| 3,879,101 | A | | 4/1975 | McKissic | |
| 3,879,109 | A | | 4/1975 | Thomas | |
| 3,945,702 | A | | 3/1976 | Poliak et al. | |
| 3,957,336 | A | | 5/1976 | Bromberg | |
| 3,975,074 | A | | 8/1976 | Fuller | |
| 3,999,829 | A | | 12/1976 | Glaesel | |
| 4,075,758 | A | | 2/1978 | Parsons et al. | |
| 4,165,443 | A | | 8/1979 | Figart et al. | |
| 4,166,934 | A | | 9/1979 | Marrero | |
| 4,243,957 | A | | 3/1980 | Sawyer | |
| 4,213,667 | A | | 7/1980 | Wittes | |
| 4,245,880 | A | | 1/1981 | Zimmerman, Jr. et al. | |
| 4,255,007 | A | | 3/1981 | Michaels et al. | |
| 4,273,957 | A | | 6/1981 | Kolling, Jr. | |
| 4,289,921 | A | | 9/1981 | Gartner et al. | |
| 4,295,018 | A | | 10/1981 | Borrelli | |
| 4,336,418 | A | | 6/1982 | Hoag | |
| 4,386,820 | A | | 6/1983 | Dola et al. | |
| 4,399,371 | A | | 8/1983 | Ziff et al. | |
| 4,443,654 | A | | 4/1984 | Flachbarth et al. | |
| 4,477,141 | A | | 10/1984 | Hardesty | |
| 4,479,692 | A | | 10/1984 | Greenwood et al. | |
| 4,531,798 | A | | 7/1985 | Baur et al. | |
| 4,545,632 | A | | 10/1985 | Maier et al. | |
| 4,550,967 | A | | 11/1985 | Riches et al. | |
| 4,553,000 | A | | 11/1985 | Appleton | |
| 4,555,418 | A | | 11/1985 | Snider et al. | |
| 4,589,719 | A | | 5/1986 | Gentry et al. | |
| 4,606,595 | A | | 8/1986 | Dola | |
| 4,627,675 | A | | 12/1986 | Taylor et al. | |
| 4,657,334 | A | | 4/1987 | Simmons | |
| 4,669,804 | A | | 6/1987 | Munroe | |
| 4,699,804 | A | | 10/1987 | Miyata et al. | |
| 4,725,249 | A | | 2/1988 | Blackwood et al. | |
| 4,759,726 | A | | 7/1988 | Naylor et al. | |
| 4,780,089 | A | * | 10/1988 | Wernick | 439/138 |
| 4,842,551 | A | | 6/1989 | Heimann | |
| 4,875,871 | A | | 10/1989 | Booty, Sr. et al. | |
| 4,917,625 | A | | 4/1990 | Haile | |
| 4,918,258 | A | | 4/1990 | Ayer | |
| 4,960,388 | A | | 10/1990 | Frantz et al. | |
| 5,015,203 | A | | 5/1991 | Furrow | |
| 5,043,531 | A | | 8/1991 | Gutenson et al. | |
| 5,046,961 | A | | 9/1991 | Hoffman | |
| 5,057,646 | A | | 10/1991 | Nichols et al. | |
| 5,092,787 | A | | 3/1992 | Wise et al. | |
| 5,117,122 | A | | 5/1992 | Hogarth et al. | |
| D329,422 | S | | 9/1992 | Fujiyoshi | |
| 5,160,808 | A | | 11/1992 | Hadfield | |
| 5,162,611 | A | | 11/1992 | Nichols, III et al. | |
| 5,167,542 | A | | 12/1992 | Haitmanek | |
| 5,178,555 | A | | 1/1993 | Kilpatrick et al. | |
| 5,185,580 | A | | 2/1993 | Nichols, III et al. | |
| 5,190,468 | A | | 3/1993 | Nichols, III et al. | |
| 5,234,355 | A | | 8/1993 | Sosinski et al. | |
| D340,912 | S | | 11/1993 | Miller | |
| D340,913 | S | | 11/1993 | Miller | |
| D341,125 | S | | 11/1993 | Miller | |
| 5,297,973 | A | | 3/1994 | Gorman | |
| 5,328,387 | A | | 7/1994 | Hoffman | |
| 5,352,122 | A | | 10/1994 | Speyer et al. | |
| 5,397,806 | A | | 3/1995 | Soled et al. | |
| 5,397,929 | A | | 3/1995 | Hogarth et al. | |
| 5,399,806 | A | | 3/1995 | Olson | |
| 5,423,695 | A | * | 6/1995 | Robinson et al. | 439/517 |
| 5,472,350 | A | | 12/1995 | Mehta | |
| 5,582,522 | A | | 12/1996 | Johnson | |
| 5,584,714 | A | | 12/1996 | Karst et al. | |
| 5,605,466 | A | * | 2/1997 | Devlin et al. | 439/144 |
| 5,641,310 | A | | 6/1997 | Tiberio, Jr. | |
| 5,662,500 | A | | 9/1997 | Yeah | |
| 5,680,926 | A | | 10/1997 | Sandor et al. | |
| 5,741,149 | A | | 4/1998 | Anthony | |
| 5,785,551 | A | | 7/1998 | Libby | |
| 5,816,733 | A | | 10/1998 | Ishikawa et al. | |
| D405,761 | S | | 2/1999 | Yu | |
| 5,865,633 | A | | 2/1999 | Hou | |
| D411,170 | S | | 6/1999 | Deutsch | |
| 5,964,618 | A | | 10/1999 | McCarthy | |
| 5,975,938 | A | | 11/1999 | Libby | |
| 6,028,268 | A | | 2/2000 | Stark et al. | |
| 6,045,374 | A | | 4/2000 | Candeloro | |
| 6,071,132 | A | | 6/2000 | Cook | |
| D430,539 | S | | 9/2000 | Leopold et al. | |
| 6,154,774 | A | | 11/2000 | Furlong et al. | |
| D434,726 | S | | 12/2000 | Middlehurst | |
| D434,729 | S | | 12/2000 | Hwang | |
| 6,156,971 | A | | 12/2000 | May | |
| 6,171,129 | B1 | | 1/2001 | Phillips | |
| 6,203,349 | B1 | | 3/2001 | Nakazawa | |
| 6,287,152 | B1 | | 9/2001 | Yang | |
| 6,309,248 | B1 | * | 10/2001 | King | 439/535 |
| 6,319,016 | B1 | | 11/2001 | Juntwait | |
| 6,328,581 | B1 | * | 12/2001 | Lee et al. | 439/106 |
| 6,341,981 | B1 | * | 1/2002 | Gorman | 439/535 |
| 6,376,770 | B1 | | 4/2002 | Hyde | |
| 6,417,450 | B1 | * | 7/2002 | Young | 174/66 |
| 6,428,339 | B1 | * | 8/2002 | Davidson et al. | 439/346 |
| 6,457,988 | B1 | | 10/2002 | Andersen | |
| 6,494,728 | B1 | | 12/2002 | Gorman | |
| 6,515,564 | B2 | * | 2/2003 | Leopold et al. | 335/18 |
| 6,544,049 | B1 | | 4/2003 | Pierson, Jr. | |
| 6,558,190 | B1 | | 5/2003 | Pierson, Jr. | |
| 6,563,049 | B2 | | 5/2003 | May | |
| 6,617,511 | B2 | * | 9/2003 | Schultz et al. | 174/53 |
| 6,669,495 | B2 | * | 12/2003 | Philips et al. | 439/170 |
| 6,739,900 | B2 | | 5/2004 | Mortun et al. | |
| 6,767,245 | B2 | * | 7/2004 | King | 439/535 |
| 6,774,307 | B2 | | 8/2004 | Kruse et al. | |
| 6,817,873 | B1 | | 11/2004 | Gorman | |
| 6,829,124 | B2 | | 12/2004 | Leopold et al. | |
| 6,831,226 | B2 | | 12/2004 | Allen, Jr. | |
| 6,843,680 | B2 | | 1/2005 | Gorman | |
| 6,843,682 | B2 | | 1/2005 | Matsuda et al. | |
| 6,845,023 | B2 | * | 1/2005 | Philips et al. | 363/132 |
| 6,857,903 | B2 | | 2/2005 | Hyde | |
| 6,863,561 | B2 | | 3/2005 | Gorman | |
| 6,870,099 | B1 | | 3/2005 | Schultz et al. | |
| 6,876,888 | B2 | | 4/2005 | Locke | |
| 6,884,111 | B2 | | 4/2005 | Gorman | |
| 6,893,297 | B2 | * | 5/2005 | Chen | 439/680 |
| 6,894,221 | B2 | | 5/2005 | Gorman | |
| 6,939,179 | B1 | | 9/2005 | Kieffer, Jr. et al. | |
| 6,945,815 | B1 | | 9/2005 | Mullally | |
| 6,955,559 | B2 | | 10/2005 | Pyrros | |
| 6,979,212 | B1 | | 12/2005 | Gorman | |
| 6,986,674 | B1 | | 1/2006 | Gorman | |
| 6,994,585 | B2 | | 2/2006 | Benoit et al. | |
| 7,004,595 | B1 | * | 2/2006 | Stoddard | 362/95 |
| 7,008,246 | B2 | * | 3/2006 | Zhuge | 439/173 |
| 7,031,602 | B2 | | 4/2006 | Faries et al. | |
| 7,052,313 | B2 | * | 5/2006 | Gorman | 439/535 |
| 7,058,525 | B2 | | 6/2006 | Bertness et al. | |

| | | | | |
|---|---|---|---|---|
| 7,060,897 | B2 | 6/2006 | Gorman | |
| 7,081,009 | B2 | 7/2006 | Gorman | |
| 7,081,010 | B2 | 7/2006 | Gorman | |
| 7,101,187 | B1 | 9/2006 | Deconinck et al. | |
| 7,104,836 | B1 | 9/2006 | Gorman | |
| 7,125,256 | B2 * | 10/2006 | Gerard | 439/21 |
| 7,160,149 | B1 | 1/2007 | Chawgo | |
| 7,168,969 | B1 * | 1/2007 | Wang | 439/173 |
| D537,414 | S | 2/2007 | Saito | |
| 7,175,463 | B2 | 2/2007 | Burton | |
| 7,189,110 | B1 | 3/2007 | Savicki, Jr. | |
| 7,195,500 | B2 * | 3/2007 | Huang et al. | 439/107 |
| 7,195,517 | B1 | 3/2007 | Savicki, Jr. | |
| 7,223,126 | B2 * | 5/2007 | Ng | 439/651 |
| 7,234,962 | B1 | 6/2007 | Lin | |
| D547,721 | S | 7/2007 | Harano et al. | |
| 7,265,291 | B1 | 9/2007 | Gorman | |
| 7,273,392 | B2 | 9/2007 | Fields | |
| 7,285,009 | B1 | 10/2007 | Benoit et al. | |
| 7,321,120 | B1 | 1/2008 | Gorman et al. | |
| D563,877 | S | 3/2008 | Grant | |
| 7,357,652 | B1 * | 4/2008 | Arenas et al. | 439/107 |
| 7,367,121 | B1 | 5/2008 | Gorman | |
| 7,407,410 | B1 | 8/2008 | Benoit et al. | |
| 7,459,632 | B2 | 12/2008 | Bowman | |
| 7,470,145 | B1 | 12/2008 | Savicki, Jr. et al. | |
| 7,510,429 | B1 | 3/2009 | Savicki, Jr. et al. | |
| 7,528,609 | B2 | 5/2009 | Savicki, Jr. et al. | |
| 7,537,472 | B1 | 5/2009 | Schwarz et al. | |
| 7,563,131 | B2 | 7/2009 | Sullivan et al. | |
| 7,597,570 | B2 | 10/2009 | So | |
| 7,601,023 | B1 | 10/2009 | Ma et al. | |
| 7,632,119 | B1 * | 12/2009 | Ma et al. | 439/172 |
| 7,632,137 | B1 * | 12/2009 | Ma et al. | 439/518 |
| 7,666,010 | B2 | 2/2010 | Arenas et al. | |
| 7,713,084 | B1 | 5/2010 | Weeks et al. | |
| 7,722,389 | B2 | 5/2010 | Benoit et al. | |
| D616,831 | S | 6/2010 | Arenas et al. | |
| D618,627 | S | 6/2010 | Arenas et al. | |
| 7,780,470 | B2 | 8/2010 | Benoit et al. | |
| 2002/0052139 | A1 | 5/2002 | Gorman | |
| 2002/0055301 | A1 | 5/2002 | Gorman | |
| 2002/0064983 | A1 | 5/2002 | Patey | |
| 2003/0236010 | A1 * | 12/2003 | Gorman | 439/107 |
| 2003/0236011 | A1 * | 12/2003 | Gorman | 439/107 |
| 2004/0130218 | A1 | 7/2004 | Locke | |
| 2004/0206541 | A1 | 10/2004 | Locke | |
| 2004/0266236 | A1 | 12/2004 | Hughes | |
| 2005/0006124 | A1 | 1/2005 | Kruse et al. | |
| 2005/0070161 | A1 | 3/2005 | Dunwoody | |
| 2005/0075007 | A1 | 4/2005 | Benoit et al. | |
| 2005/0250377 | A1 | 11/2005 | Gorman | |
| 2005/0250378 | A1 | 11/2005 | Gorman | |
| 2005/0272304 | A1 | 12/2005 | Gorman | |
| 2005/0272305 | A1 | 12/2005 | Gorman | |
| 2006/0030183 | A1 * | 2/2006 | Yoshida et al. | 439/107 |
| 2006/0286874 | A1 | 12/2006 | Ritchie | |
| 2008/0149551 | A1 | 6/2008 | Brugger et al. | |
| 2008/0268679 | A1 | 10/2008 | Tiberio et al. | |
| 2009/0053925 | A1 | 2/2009 | Pyrros | |
| 2009/0197461 | A1 | 8/2009 | Benoit et al. | |
| 2009/0227122 | A1 | 9/2009 | Jubelirer et al. | |
| 2010/0227484 | A1 | 9/2010 | Arenas et al. | |

FOREIGN PATENT DOCUMENTS

| | | |
|---|---|---|
| JP | 6014026 | 1/1994 |
| JP | 10-321328 | 4/1998 |

OTHER PUBLICATIONS

International Preliminary Report on Patentability for PCT/US20071082460; Mailed on May 7, 2009; 8 pages.

"Practical Electrical Wiring" by Herbert P. Richter and W. Creighton Schwan, 17th edition, Chapter 8, New York: McGraw-Hill Companies, 1996, 13 pages.

BRK Electronics; User's Manual—Smoke Alarms; Jun. 2000, as disclosed in Reissue U.S. Appl. No. 95/000,200.

U.S. Office Action Mailed on Oct. 18, 2010 for U.S. Appl. No. 12/685,656, filed Jan. 11, 2010.

U.S. Notice of Allowance Mailed on Jan. 25, 2011 for U.S. Appl. No. 12/685,656, filed Jan. 11, 2010.

U.S. Notice of Allowabilty Mailed on Feb. 22, 2011 for U.S. Appl. No. 12/685,656, filed Jan. 11, 2010.

Office Action dated Jul. 13, 2011 for U.S. Appl. No. 13/099,318.

U.S. Final Office Action Mailed on Oct. 27, 2011 for U.S. Appl. No. 13/099,318, filed on May 2, 2011.

* cited by examiner

FIG. 3A
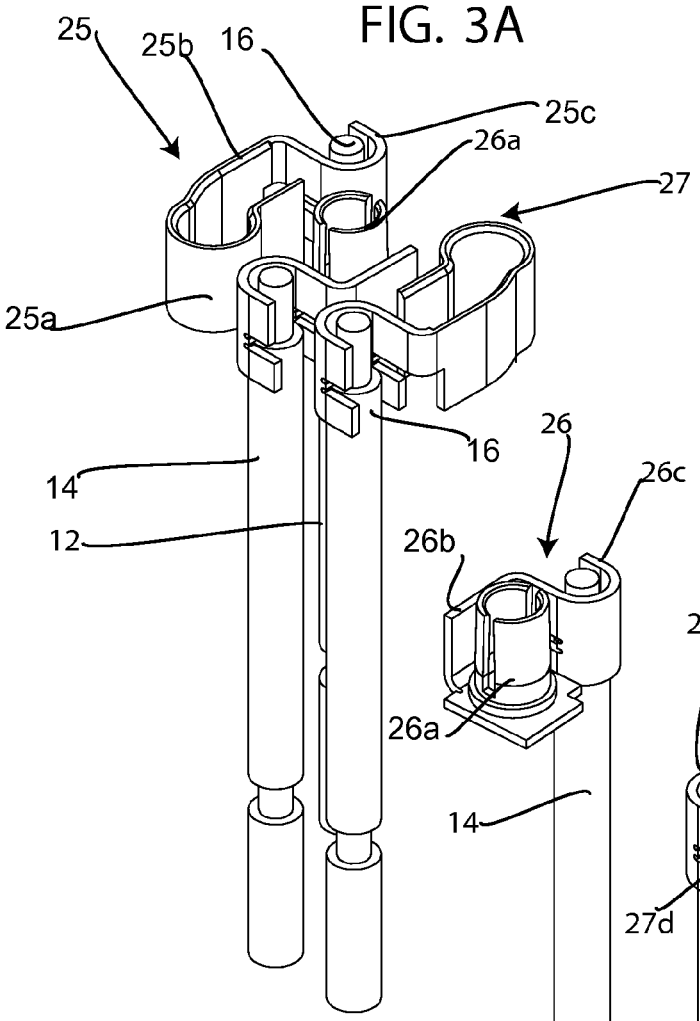
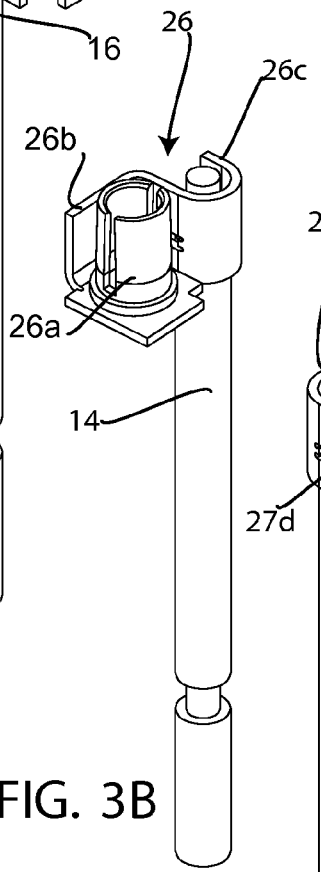
FIG. 3B
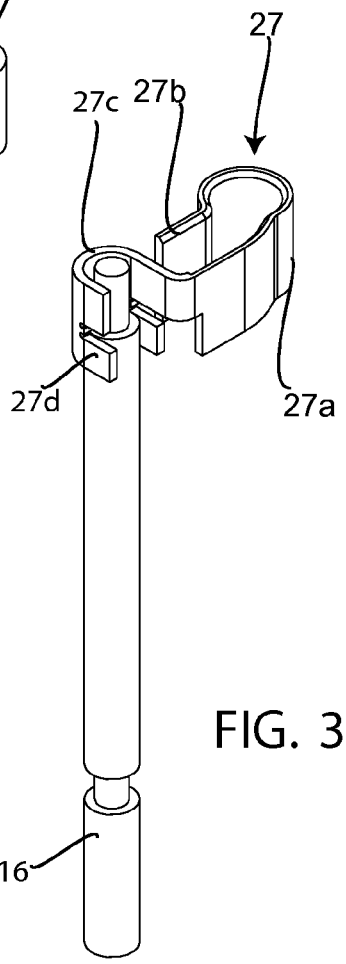
FIG. 3C

MODULAR WIRING SYSTEM WITH LOCKING ELEMENTS

CROSS REFERENCE TO RELATED APPLICATION

This application is a continuation application of U.S. patent application Ser. No. 12/040,648 filed on Feb. 29, 2008, titled "MODULAR WIRING SYSTEM WITH LOCKING ELEMENTS" wherein that application is a continuation in part application and hereby claims priority from U.S. patent Ser. No. 11/553,793 filed on Oct. 27, 2006, titled "Modular Wiring System with Locking Elements", now issued as U.S. Pat. No. 7,357,652 the disclosure of both of these documents are hereby incorporated herein by reference in their entirety.

BACKGROUND

One embodiment relates to a modular wiring system having locking elements. The wiring system comprises a wiring unit or module and a functional unit or functional module. The wiring unit can be for coupling to the ends of wires such as a phase wire, a neutral wire and a ground wire. The functional module can be for example in the form of a receptacle or a light switch. Other types of modular units are known in the art, for example, U.S. Pat. No. 7,052,313 to Gorman, which issued on May 30, 2006, the disclosure of which is hereby incorporated herein by reference in its entirety.

SUMMARY

One embodiment of the invention relates to a modular wiring system comprising a functional unit and a wiring unit. There is also a system for coupling the functional unit to the wiring unit in a rotational manner. This system can be formed from at least one locking element or prong comprised of electrically conductive material. The prong can also be known as a branch, arm, fin, projection, post, or rod depending on its shape. When the functional unit is coupled to the wiring unit, the locking element or prong is both electrically and physically coupled to the functional unit at a first end and to the wiring unit at a second end. Alternatively, or in addition, the system for coupling the functional unit to the wiring unit in a rotational manner can include at least one flange coupled to the functional unit and at least one flange coupled to the wiring unit. These flanges operate such that when the functional unit and the wiring unit are placed together, they are rotated to form a locking connection between the flange on the functional unit and the flange on the wiring unit.

An example or first embodiment of the invention can include a functional unit comprising a housing, at least one functional interface coupled to the housing, and at least one locking element or prong extending out from the housing. This locking element or prong has a first section forming a base connection section and a second section forming a locking section. The functional unit or module can comprise an in wall mountable unit which can be installed into a wall box such as a single gang electrical enclosure. Single gang electrical enclosures have known sizes which are known in the field of electrical wiring and therefore need no further explanation. Because the functional module can be installed into a wall box, in a preferred embodiment, its back face is configured to connect to a wiring module or wiring unit.

The wiring unit comprises a housing having at least one opening and at least one front face forming a connection interface for the locking section of the locking element or prong.

In one embodiment, this locking element or prong can be in the form of a substantially cylindrically shaped prong made from electrically conductive material. Alternatively, the locking element or prong can be in the form of a plate or curved arm made from electrically conductive material.

This locking element or prong can include a first base section that is smaller in area than the second locking section. The locking section can be in the form of a locking flange which can be used to interact with an inside region of the front face of the housing to lock the functional unit to the wiring unit.

In addition to the locking prongs, there can also be locking flanges, which can be used to couple the functional unit to the wiring unit. For example, both the functional unit and the wiring unit can comprise at least one, or multiple locking flanges, which facilitate the connection of these two units together. In this case, at least one locking flange is in the form of a fixed latch tab. Alternatively, at least one locking flange can be in the form of a latch release tab which functions as a leaf spring.

The functional unit and the wiring unit are coupled to each other in a rotational manner. To facilitate this type of connection, the functional unit further comprises at least one raised surface disposed on its back face. This raised surface is for allowing the wiring unit to couple to the locking element on the functional unit and then rotate on the raised surface.

The wiring unit can be designed such that it has at least one opening wherein the opening can be wider in a first section and then narrower in a second section. In this case, the functional unit includes a locking element prong having a narrower base and a wider end portion. With this design, the first wider receiving region is adapted to receive said wider end portion of the locking element or prong, such that when said wiring unit is put in functional contact with the functional unit, the wider end portion inserts into the wider receiving region. Next, the wiring unit is rotated relative to the functional unit such that the wider end portion on the locking prong rotates into the second narrower locking region on the wiring unit to lock the functional unit to the wiring unit. This locking function occurs when the wider end portion is disposed under the narrower region on the wiring unit and essentially locked inside of the housing of the wiring unit.

One of the numerous advantages of this type of connection system is that both the wiring unit and the functional unit are easily connectable to each other such that the functional unit and the wiring unit can be simply rotated relative to each other to move from an unlocked to a locked position, or rotated back to move from a locked to an unlocked position.

When the functional unit and the wiring unit are coupled together, the locking flanges on the wiring section rotate around and snap underneath the locking flanges on the functional unit. On the wiring unit, at least one of the flanges is in the form of a lead flange which has a curved leading edge which interacts with a flange on the functional unit which acts as a latch release tab.

The latch release tab is in the form of a movable leaf spring which can be pushed back via the rotational interaction of the curved leading edge of the lead flange on the wiring unit. The lead flange on the wiring unit also includes a locking projection in the form of a lip or flange which extends substantially perpendicular to the extension of the body of the lead flange. When the wiring unit is rotated into a locked position, this locking projection snaps past the latch release tab and then forms a rim locking the wiring unit in place. To release the wiring unit from the functional unit, the latch release tab is pulled back away from the body of the wiring unit, releasing the locking projection, which then allows the wiring unit to rotate back around and then release from the functional unit.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views:

FIG. 3A is a perspective view of the interior components shown in the wiring unit shown in FIG. 2B;

FIG. 3B is a perspective view of one of the interior components in the wiring unit in FIG. 2B;

FIG. 3C is a perspective view of another one of the interior components shown in FIG. 3A;

DETAILED DESCRIPTION

Figure 1:
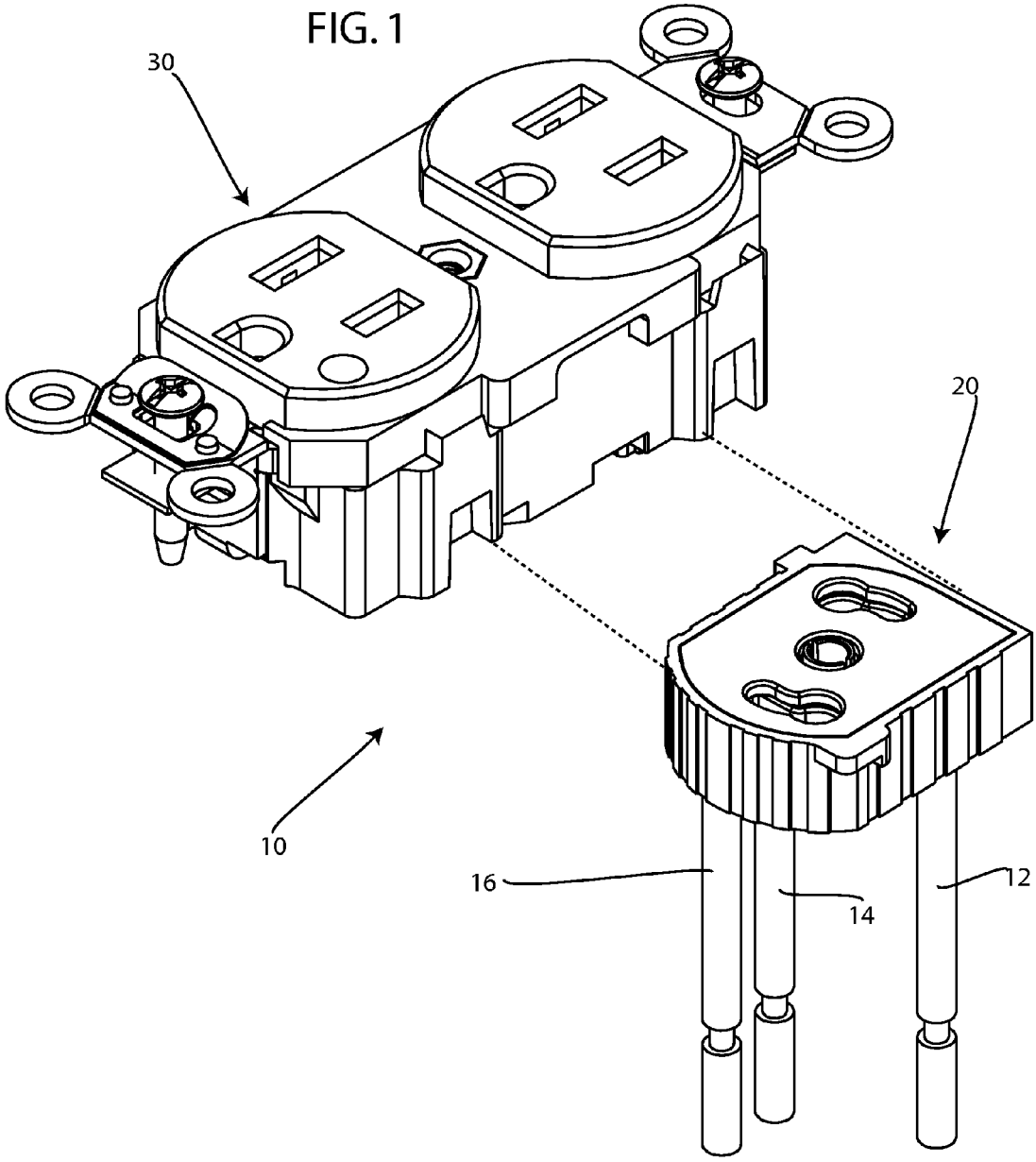
FIG. 1 is a perspective view of a first embodiment of the device including a wiring unit and a functional unit.

Referring to the drawings, FIG. 1 is a front perspective view of a first embodiment of a device 10 comprising a wiring module or unit 20, and a functional module or unit 30. Wiring module or unit 20 is coupled to wires 12, 14, and 16. In this example, wire 12 is a hot or phase line, serving as a power input line, wire 14 is a ground line, while wire 16 is a neutral line.

Figure 2A:
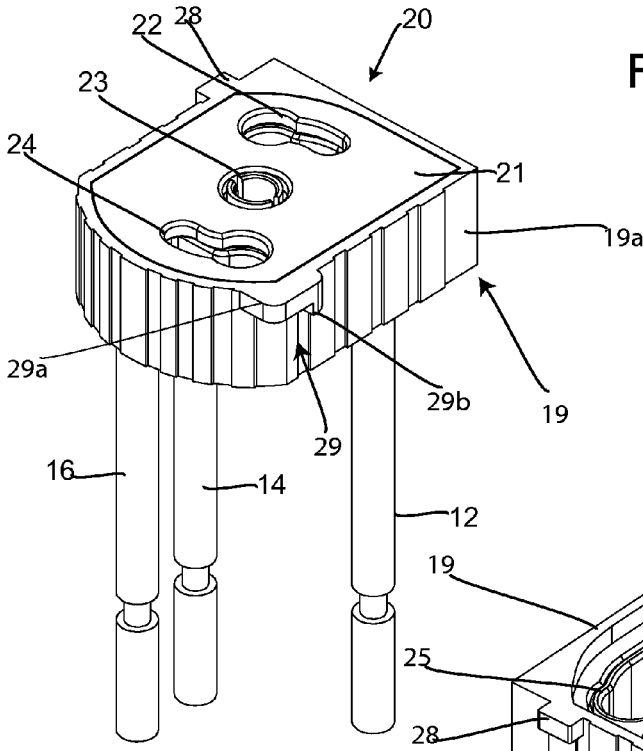
FIG. 2A is a front perspective view of a first embodiment of the wiring unit.

FIG. 2A is a front perspective view of wiring or connecting module or unit 20 which can be coupled to functional module or unit 30 as shown in FIG. 1. In this view, there is shown a body 19 having a perimeter region 19*a*, a front face 21 and functional interactive elements 22, 23 and 24. Opposite functional face 21 are three wires 12, 14 and 16 which pass through the back end of wiring or connecting unit 20. There are also tabs or flanges 28 and 29 which are coupled to base body 19 (see FIG. 4A). These tabs or flanges 28 and 29 are disposed in opposite corners from each other and are used to assist in locking the wiring unit to the functional unit. Flange 28 is in the form of a substantially rectangular flange, while flange 29 is a lead flange and includes a body section 29*a* and a locking projection 29*b* which extends substantially perpendicular to the body section 29*a*.

Figure 2B:
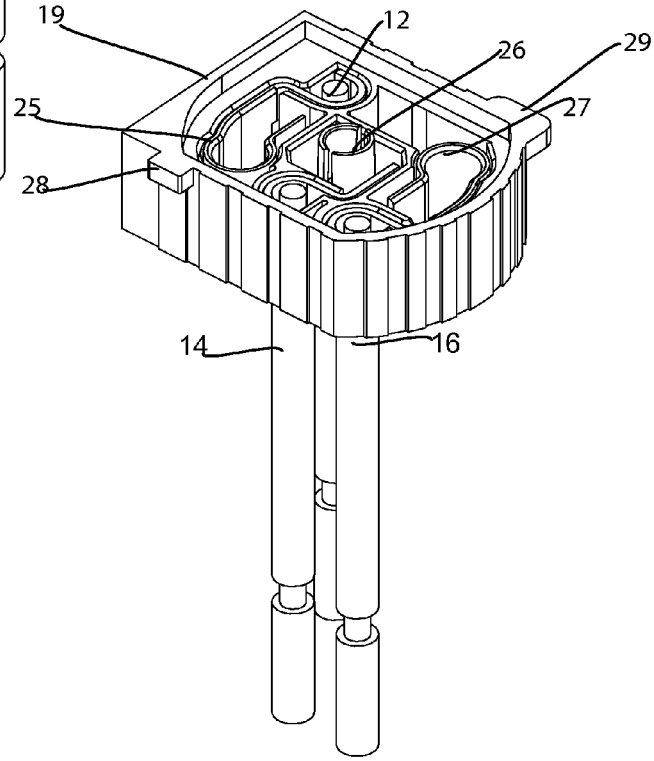
FIG. 2B is a front perspective view of an open face on the wiring unit.

FIG. 2B discloses a front perspective open view of wiring unit 20. In this view, there is shown a central shaft 26 disposed inside of body 19 for receiving a ground pin. In addition, there is also shown wiring connectors 25 and 27 which are disposed in body 19 and are each respectively coupled to hot wire 12 and neutral wire 16. In addition, central shaft 26 is electrically coupled to ground wire 14.

FIGS. 3A-C disclose wiring connectors 25, 26 and 27. For example wiring connector 25 is for connecting to wire 12, while wiring connector 27 is for connecting to wire 16 while wiring connector 26 is for connecting to wire 14. Wiring connector 25 includes a body section 25*a* and a narrower connecting region or locking region 25*b*. There is also a wire contact region 25*c* and a wire insulation connection region 25*d* (not shown). Body section 25*a* is a rounded region for receiving a locking device; in this case a connecting prong or a locking pin would insert into an open wider body section 25*a* and rotate down into a narrower or smaller locking region 25*b*. Wire contact region 25*c* can be crimped onto an open exposed wire such as a phase wire, which allows electrical current to flow through. The wire insulation connection region can be used crimp on to the insulated part of the wire.

In addition, there is also a corresponding wire connector 27 which includes a body section 27*a*, a locking region 27*b*, wire contact region 27*c*, and a wire insulation connection region 27*d*. Body section 27*a* includes a wider rounded region for receiving any form of a locking device. In this case the locking device would be a locking pin, which would insert into body section 27*a* and then rotate down into a narrower or smaller locking region 27*b*. In addition, wire contact region 27*c* can be crimped onto an open exposed wire such as wire 16. In addition, a wire insulation connection region 27*d* can be crimped onto the body of the shielded part of the wire as well.

There is also shown wiring connector 26, which includes a body section 26*a* for receiving a ground pin. There is also a terminal section 26*b* and a wire connection section 26*c* which can be crimped onto a wire such as a ground wire 14. These three wire connectors 25, 26, and 27 can be made from an electrically conductive material such as a metal.

Figure 4A:
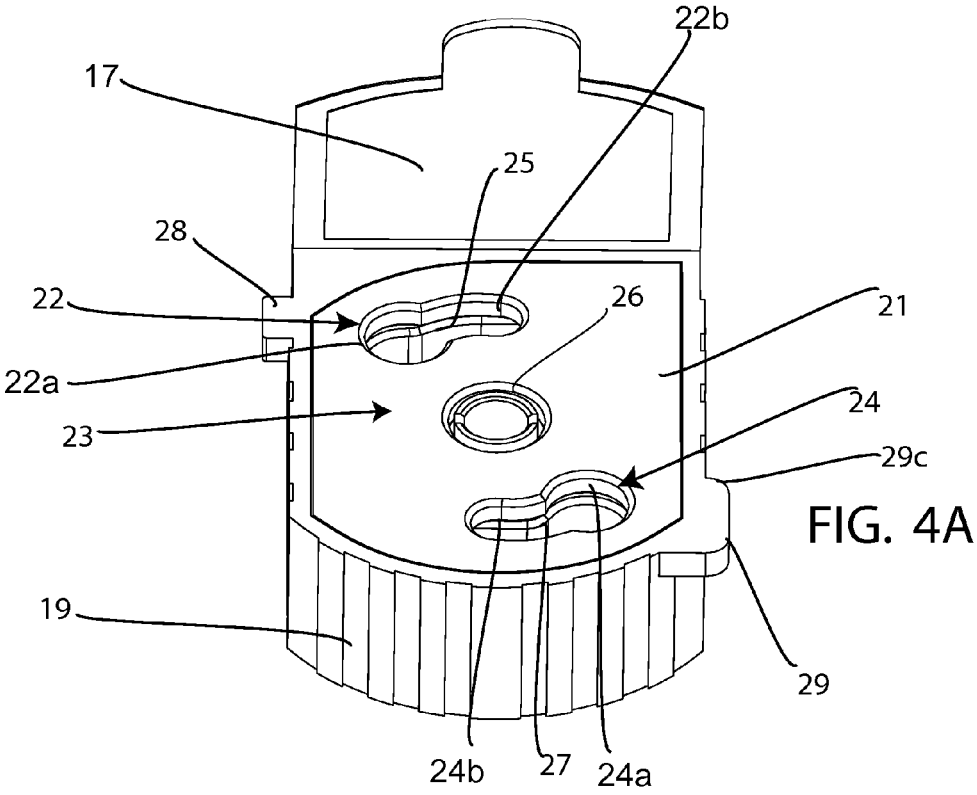
FIG. 4A is a perspective view of another embodiment of the wiring unit.

FIG. 4A discloses a front perspective view of wiring unit 20 which includes base or body 19 front face 21 and functional interfaces 22, 23 and 24. In this case, there is shown a functional interface 22 having a receiving region 22*a* and a locking region 22*b*. In addition, functional interface 24 has a receiving region 24*a* and locking region 24*b*. These regions correspond with the respective body wiring connector section

Figure 4B:
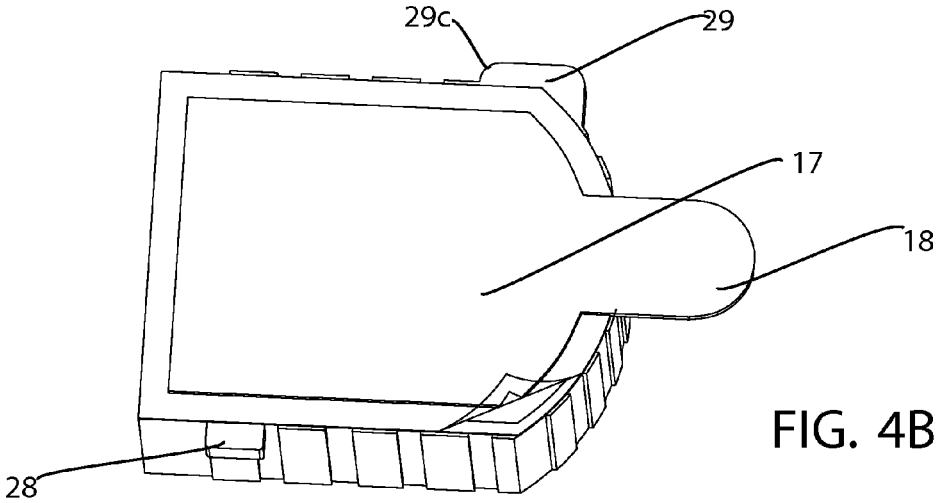
FIG. 4B is a perspective view of the embodiment shown in FIG. 4A with the cover closed.

25*a* and locking region 25*b* and body section 27*a* and locking region 27*b* (See FIG. 3A). There is also a removable cover 17 which can be made from a film type material having an adhesive for allowing the selective removal of this cover. As shown in FIG. 4B, removable cover 17 includes a tab 18, which allows a user to grip and remove cover 17. Cover 17 may optionally contain a region which may allow for pre-printing or manual writing for identification purposes such as circuit or other identification. FIGS. 4A and 4B both show flanges 28 and 29 wherein flange 29 is shown as having a curved leading edge 29*c*.

Figure 5A:
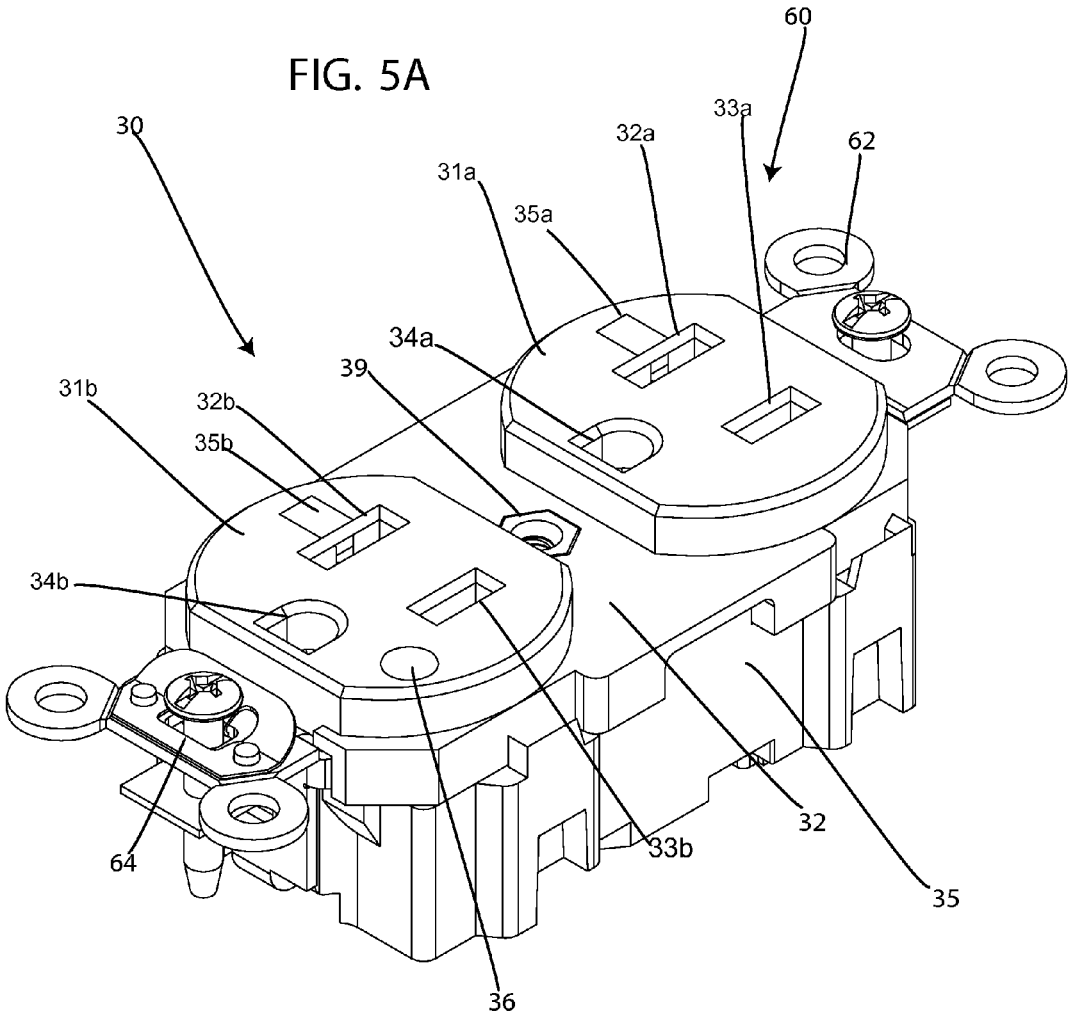
FIG. 5A is a front perspective view of the functional unit shown in FIG. 1.

As shown in FIG. 5A, there is a functional unit or receptacle 30 which includes a housing including a front face plate 32, and a body section 35. There is also a strap 60 including strap elements 62 and 64 extending out from both ends of the housing. Front face plate 32 includes plug blade openings 32*a*, 33*a* and ground pin opening 34*a* in a first outlet 31*a*. Blade opening 32*a* can also be designed to include an additional optional slot 35*a*. In addition, there are also prong openings 32*b*, 33*b* and also ground pin opening 34*b* in second outlet 31*b*. Blade opening 32*b* can also be designed to include optional slot 35*b*. Disposed in second receptacle 31*b* can be a LED light indicator 36, which can be used to indicate whether the wiring unit 20 is connected to the functional unit 30. There is also a fastener 39 for securing front plate 32 to base housing 35. Either one of these user accessible interfaces 31*a* or 31*b* can receive a standard plug.

Figure 5B:
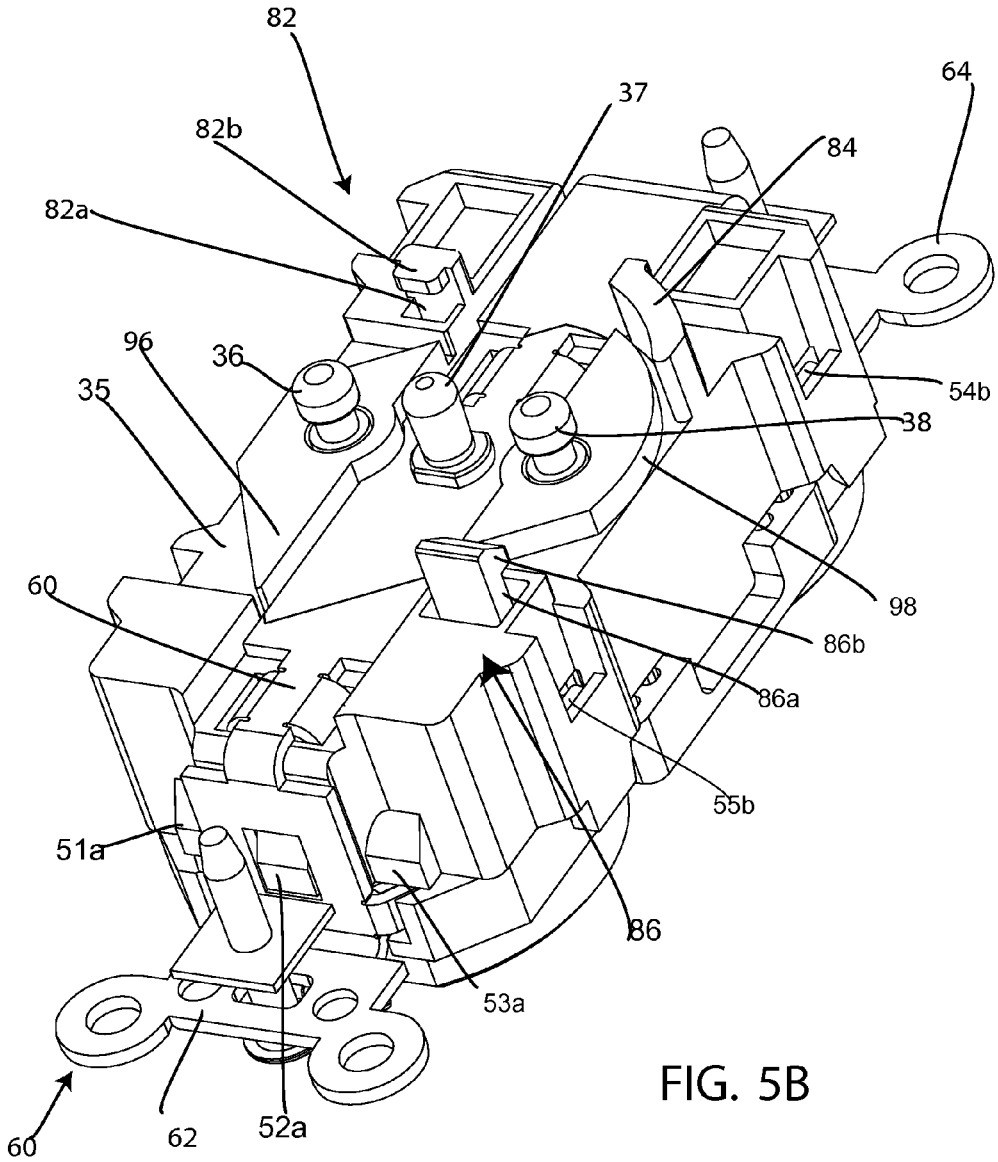
FIG. 5B is a back perspective view of the functional unit shown in FIG. 5A.

FIG. 5B shows a back view of this receptacle unit 30, wherein this receptacle unit is also shown in FIG. 5A. For example in this view there is shown the back end view of body 35 which includes raised connection sections 96 and 98 which can be used to allow the front face of wiring unit 20 to slide and rotate across the outer surfaces of body 35. Also, raised connection sections 96 and 98 provide the user with a visual indication of how to orient the wiring unit 20 for proper connection to the functional unit 30. The outer edges of raised connection sections 96 and 98, along with lines on the back surface of the strap 60 form the approximate shape of the wiring unit 20 in the correct orientation for connecting to functional unit 30. In addition, these sections include gaps disposed between a plurality of connection brackets 82, 84, and 86. First connection bracket 82 is in the form of an L-shaped connection bracket or locking flange, which includes a first extending component 82*a* extending out from the back face of body 35. The second extending component 82*b* is in the form of an overhang, which extends in a position substantially perpendicular to the first extending portion and extends parallel to an approximate plane formed by the back face of body 35. This first connection bracket acts as a fixed latch tab, which is formed integral with body 35 and is used to couple or lock down a corresponding flange 28 on wiring unit 20.

Second connection bracket 84 is in the form of a curved connection bracket which is disposed adjacent to connection section 98. This portion is curved to facilitate or guide the rotation of a side body section 19 of wiring module 20 once the wiring module 20 is in its initial coupling position with functional unit 30. Additionally, this connection bracket 84 is also in the form of a rejection post which is used to key the wiring unit to the proper polarity. With this rejection post, a user could not connect the wiring unit 20 to a functional unit with reverse polarity because if a user tried to insert the wiring unit 20 in an improper manner, it would hit or interact with rejection post 84 before properly connecting to the functional unit 30.

Third connection bracket 86 is also in the form of a locking flange and includes a first extending section 86*a* which extends out from the back face of the base 35 and an overhang or hook 86*b* which extends out substantially perpendicular to this first extending section 86*a*. This connection bracket 86 functions as a latch release tab and which is movable laterally to receive the associated rotating flange 29 on the wiring unit 20.

This view also shows strap 60 having end 62 and 64 and also connection elements 51*a*, 52*a*, 53*a*, 54*b* and 55*b* for coupling base 35 to face 32. There are also connection elements or prongs 36, 37 and 38, which can be used to allow functional unit 30 to connect to wiring unit 20.

Figure 5C:
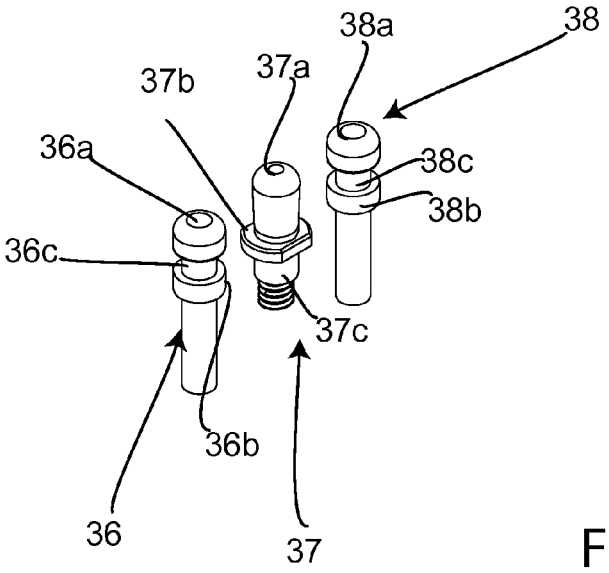
FIG. 5C is a perspective view of the connecting prongs shown in FIG. 5B.

FIG. 5C shows a perspective view of the connecting prongs or locking pins 36, 37 and 38. Locking pin 36 includes a first bulb section 36*a*, a second annular ring section 36*b* and a base section 36*c* which extends on both sides of ring section 36*b*. In addition, locking pin 38 includes a bulb section 38*a*, an annular ring section 38*b* and a base section 38*c* which extends on both sides of ring section 38*b*. Essentially, bulb sections 36*a*, and 38*a* each along with ring sections 36*b*, and 38*b* respectively form a channel in base sections 36*c* and 38*c* disposed between the sections.

When bulb sections 36*a* and 38*a* are inserted into a wiring unit, bulb sections 36*a* and 38*a* engage initial openings 22*a* and 24*a* respectively (See FIG. 4A). Once these bulb sections 36*a* and 38*a*, respectively have been inserted into the body of wiring unit 20, wiring unit 20 can then be rotated. Upon the occurrence of this rotation, these connection pins or prongs 36 and 38 rotate within these channels such that bulbs 36*a* and 38*a* slide underneath the narrower sections 22*b* and 24*b* and also inside narrower channels 25*b* and 27*b* shown in FIGS. 3A and 3C. Rotation of the wiring unit clockwise with respect to functional unit locks the wiring unit to the functional unit.

Once the two units are locked together, a counterclockwise rotation will unlock the two units (if the latch release is activated) and allow for their separation. The direction of rotation to lock or unlock the two units is intuitive to the end-user as a clockwise rotation is generally recognized as turning a device ON and counterclockwise is generally recognized turning a device OFF (such as with a valve, tightening a fastener, or assembling locking electrical connectors commonly used in the electrical industry).

Once this rotation has been completed, these prongs are locked therein such that bulbs 36*a* and 38*a* are now disposed underneath front faceplate 21, inside the narrower channels 22*b* and 24*b*. In addition, upon this rotation, locking flanges 28 and 29 connect or interact with locking flanges 82, 84, and 86 to lock wiring unit 20 to functional unit 30. Locking flange 82 is in the form of a fixed latch tab, while locking flange 86 is in the form of a latch release tab that acts as a leaf spring. For example, in this way, locking flanges 28 and 29, which form extensions extending out from body 19 slide underneath laterally extending regions 82*b* and 86*b*. Because locking flange 86 is in the form of a latch release tab, once a leading edge 29*c* of locking flange 29 contacts latch release tab 86 it drives or snaps latch release tab 86 back allowing latch 29 to pass underneath this locking flange 86. Locking projection 29*b* on locking flange 29 has an inside face that is now in contact with an inside face 86*c* (See FIG. 6A) of locking flange 86 locking the wiring unit 20 against rotation. Once these flanges 28 and 29 slide underneath these overhangs, and once bulbs 36*a* and 38*a* are locked inside of housing 19, the wiring unit 20 is then locked to functional unit 30 in a secure manner. This is because overhangs 82*b* and 86*b* lock into locking flanges 28 and 29 and keep wiring module 20 locked into functional unit 30.

To unlock wiring unit 20 from functional unit 30, a user can then pull back on locking flange 86 and then rotate wiring unit 20 in a counter clockwise manner allowing locking flange 29 to pass underneath overhang 86*b* and rotate into a releasable position.

Figure 6A:
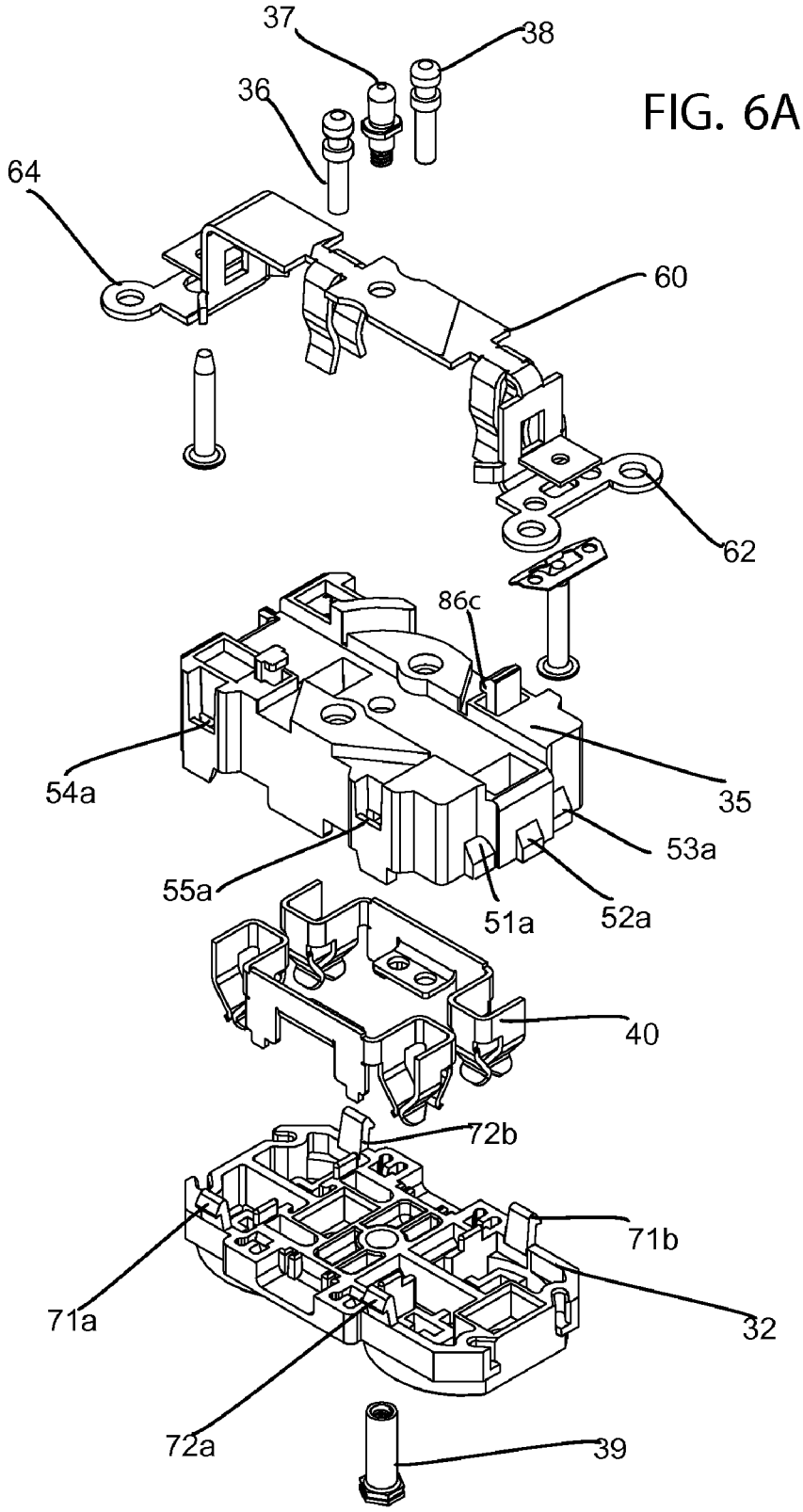
FIG. 6A is a back perspective exploded view of the functional unit.
Figure 6B:
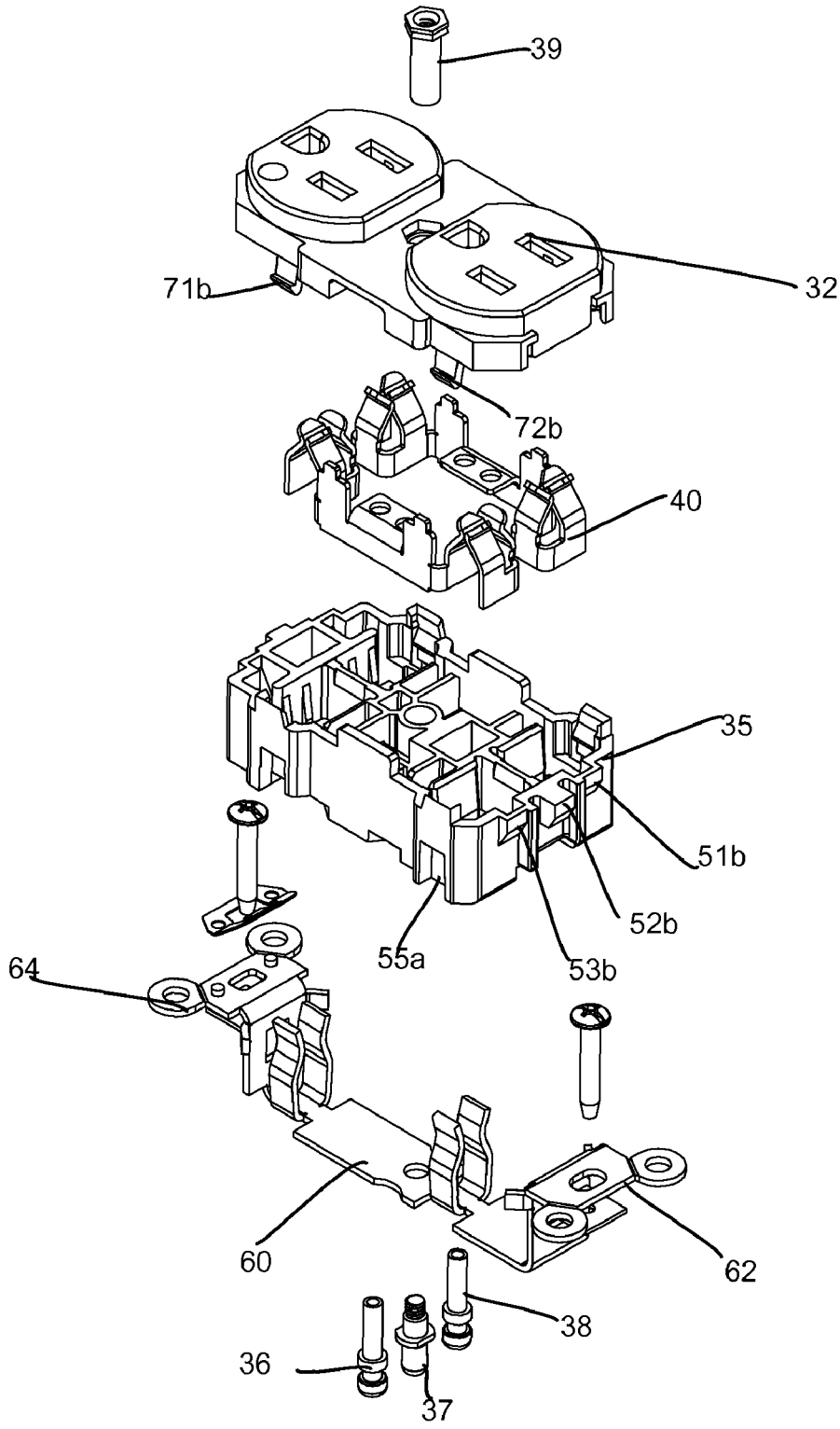
FIG. 6B is a front perspective exploded view of the functional unit shown in FIG. 6A.

FIGS. 6A and 6B disclose a back perspective exploded view and a front perspective exploded view respectively of a functional unit which is the same or similar to that shown in the first embodiment. In both of these views, there is shown a front face plate 32 which is connected to base or housing block 35. Receptacle contacts 40 are disposed between front plate 32 and base block 35. Strap 60 is coupled to a back of base block or base housing 35.

There are a plurality of connecting prongs, or pins 36, 37, and 38. Connection pins 36 and 38 are respectively for making connection to a phase and a neutral of the electrical supply. Connection pin 37 is for connecting to a ground. Base housing block 35 includes flange or end connection elements 51*a*, 52*a*, and 53*a*. In addition, there are also opposite side or also flange or end connection elements 51*b*, 52*b*, and 53*b*. There are also side connection elements 54*a* and 55*a* shown in FIG. 6A and also side connection elements 54*b* and 55*b* (See FIG. 5B).

Front face plate 32 includes side connection clips 71*a*, 72*a* and oppositely spaced connection clips 71*b* and 72*b*. These connection clips are adapted to interact with side flange elements 54*a* and 55*a* on a first side and 54*b* and 55*b* on the opposite side (See FIG. 5B).

Thus, when front face plate 32 snaps down on base housing block 35 these clips snap into the side flanges, thereby locking contacts 40 inside of the housing. FIG. 5A discloses the perspective view of functional unit 30, which has been assembled in its final condition. In addition, FIG. 5B discloses a back perspective view of the device in assembled condition.

Figure 7:
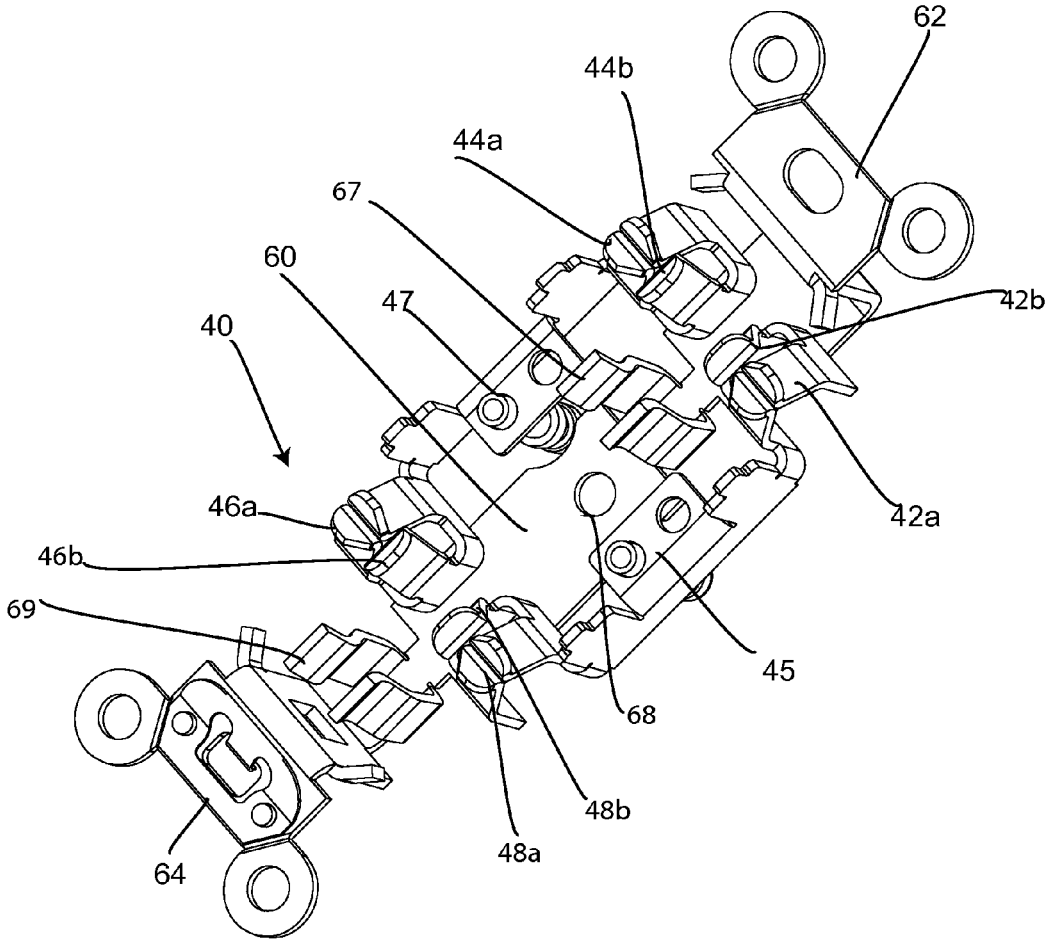
FIG. 7 is a front view of the strap and additional components shown in FIG. 6A and FIG. 6B.

FIG. 7 discloses a front perspective view of contacts 40 and strap 60 of functional unit 30. Contacts 40 can be in the form of an electrically conducting material. Contacts 40 include prong interfaces 42*a*, 44*a*, 46*a*, and 48*a*, and side prong interfaces 42*b*, 44*b*, 46*b*, and 48*b*. These prong interfaces are for receiving prongs from an electrical device such as a plug. In addition, contacts 40 are also connected to, or formed continuous with prongs or connecting elements 36 and 38 (not shown). Contacts 40 can be disposed at least partially inside of a base housing 35 which is made of a electrically insulating material such as a thermoset or a thermoplastic compound. Base housing 35 is coupled to front face plate 32, on a front end, and is coupled on a back end to strap 60. One example of a strap is strap 60 which includes strap extensions 62 and 64. In addition, strap 60 also includes strap prongs 67 and 69 for connecting into openings in body 35. Strap 60 also includes a hole 68 for receiving a ground connection pin 37, which extends out to a back end of strap 60. Connection pin 37 threads into female threads within fastener 39 (See FIG. 6A or 6B) to establish a ground path and also to aid in securing the functional unit together.

Figure 8B:
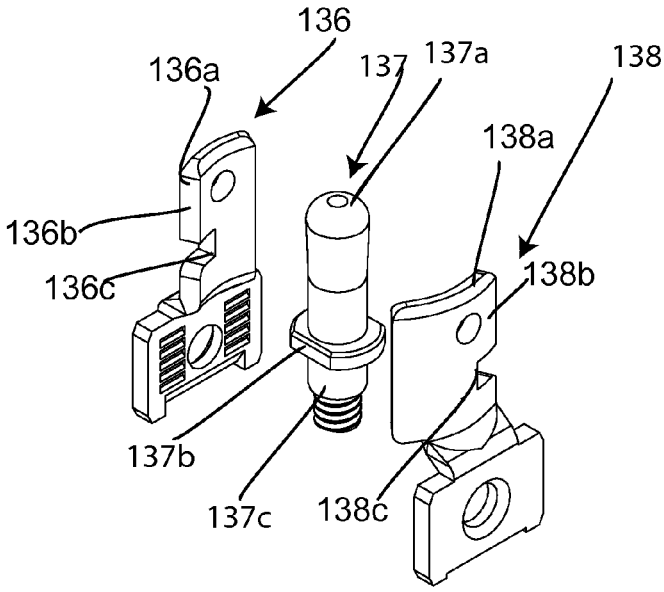
FIG. 8B is a perspective view of the connecting prongs shown in FIG. 8A.
Figure 8A:
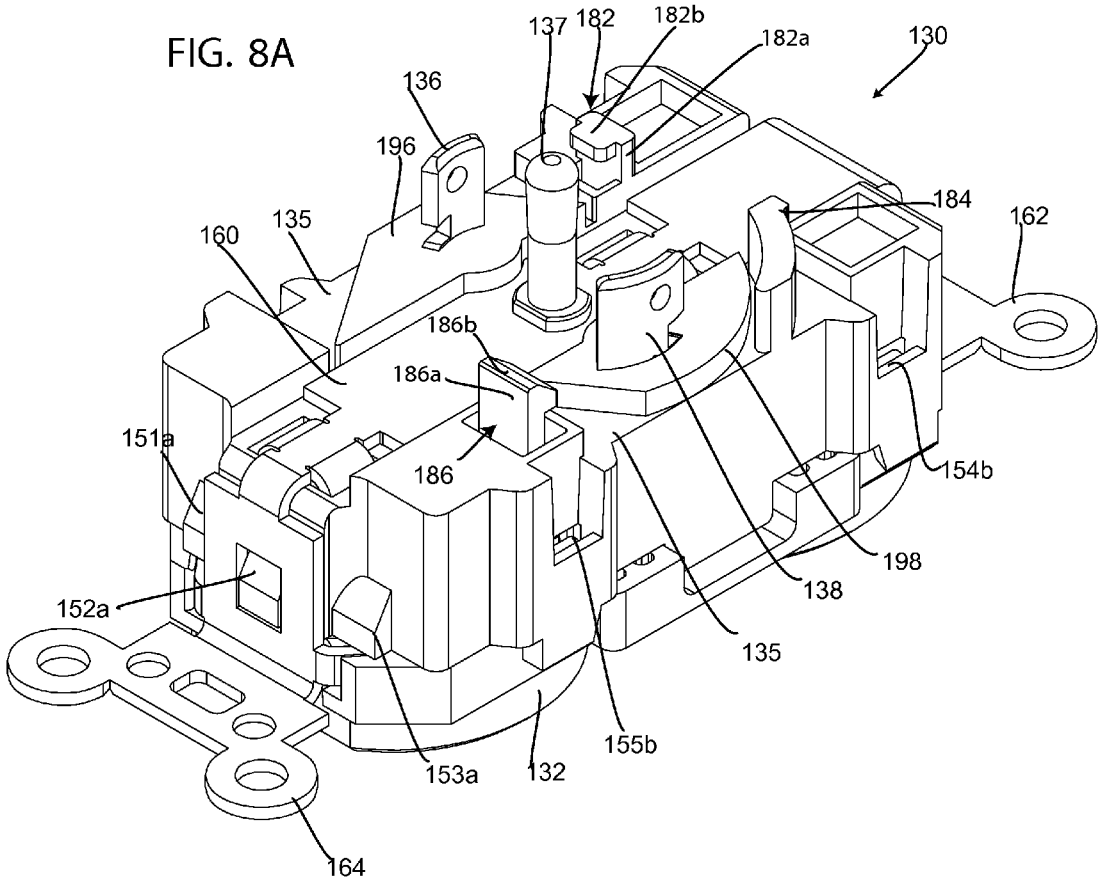
FIG. 8A is a back perspective view of a second embodiment of the functional unit.

FIG. 8A is a perspective view of a second embodiment of the invention. In this view, a second embodiment of functional unit 130 is shown. This functional unit 130 has a front face plate 132 and a body 135. There are also prongs 136 and 138 and a central ground pin shaft 137 extending out from body 135. Prongs 136 and 138 are shown in greater detail in FIG. 8B. There is also a strap 160 which has strap extensions 162 and 164 extending out therefrom. This body 135 also contains a plurality of flanges which form connection elements, which can be used to allow additional elements such as a front face plate 132 or strap 160 to connect thereto. These flange elements can be in the form of snap locking element 151*a*, which locks front face plate 132 to body 135, locking elements 152*a*, and 153*a* which lock strap 160 to the body 135. In addition, there is shown locking flange 154*b*, and 155*b*, which is coupled to front face plate 132 and allows front face plate 132 to couple to body 135.

There are also locking flanges 182, 184, and 186 coupled to body 135. Locking flange 182 includes a first section 182*a*, which includes a section extending perpendicular out from a back face of body 135. There is also an overhang region 182*b*, which extends substantially perpendicular to extension element 182*a*. This locking flange is in the form of a fixed latch tab. There is also locking flange 184, which extends in a substantially circular manner around connection plate 198, which functions as a locking post to force the wiring unit to connect with proper polarity. Finally there is also another locking flange in the form of a catch or lock 186, which extends up and out from body 135 and also includes an extending section 186*a* and a catch or overhang 186*b* for catching flange 129 shown in FIG. 9. This lock or latch 186 acts as a latch release tab similar to latch release tab 86 described above.

Figure 9:
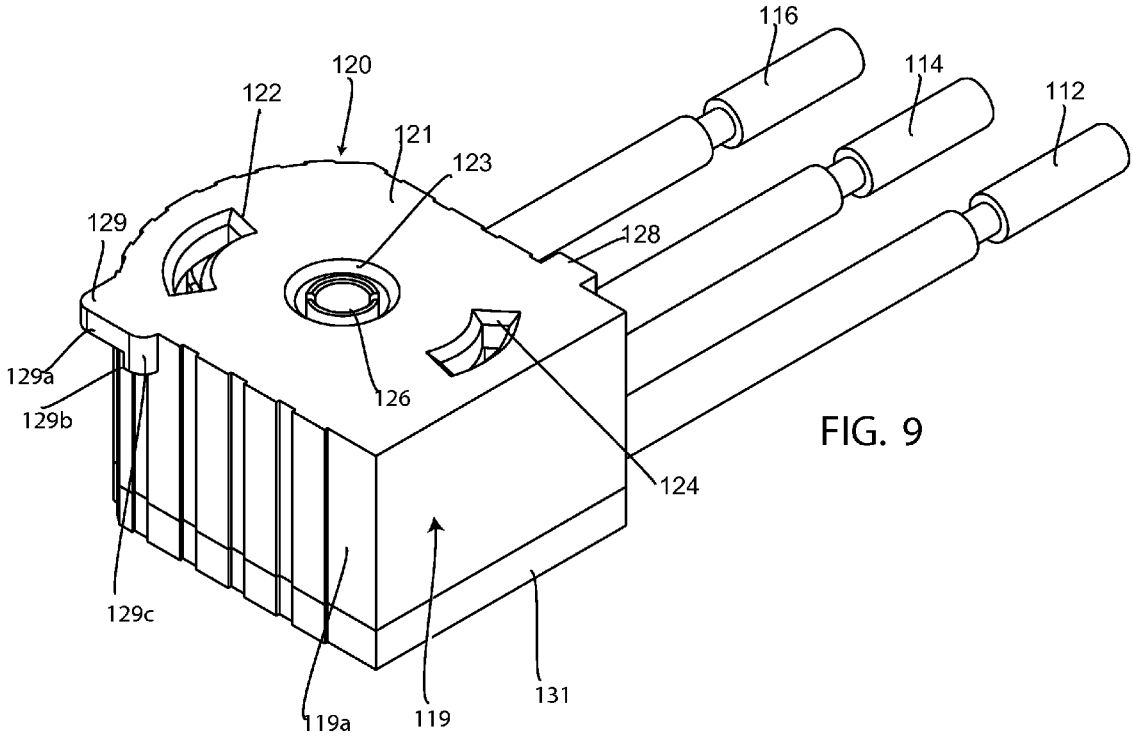
FIG. 9 is a perspective view of another embodiment of the wiring unit.

Connection surfaces 196 and 198 are designed for receiving a front face 121 of wiring unit 120 shown in FIG. 9. In this view, there are a plurality of connection wires 112, 114, and 116 which can be in the form of a hot wire 112, a ground wire 114, and a neutral wire 116. In addition, this wiring unit 120 can include a body section 119 having a perimeter region 119*a* extending around this body section and a front face 121 having a first prong opening 122, a second prong opening 124 and a ground pin opening 123. Ground pin opening 123 includes space for a cylinder 126 for receiving ground pin 137. In addition, openings 122 and 124 are designed for receiving prongs 138 and 136 respectively.

Prongs 136 and 138, which are shown in greater detail in FIG. 8B include a first section 136*a*, which is an initial contact region. A second body section 136*b* includes a hole, wherein this body section then narrows to a narrow or smaller section 136*c*. In addition, prong 138 includes an initial connection region 138*a*, the second body section 138*b* having a hole and a third narrow or smaller region 138*c*. These narrow regions 136*c* and 138*c* are designed to form catches such that when the wiring unit 120 is coupled to the back surface of housing 135, these prongs, arms, or branches 136 and 138 slide into openings 122 and 124 such that once connection element 120 is rotated, a flange (not shown but disposed inside of the housing) locks into narrower openings in regions 136*c* and 138*c* to lock these prongs therein. In this case, connection wires 112, 114, and 116 extend out from a side region so that with this design, the wiring unit does not require as much space in a wall mounted box. In addition, this side extending wiring feature can also be used with wiring unit 20 as well. When there is a side wiring configuration, the depth of the wiring unit is less as well further enhancing the space saving features of this wiring unit.

Figure 10:
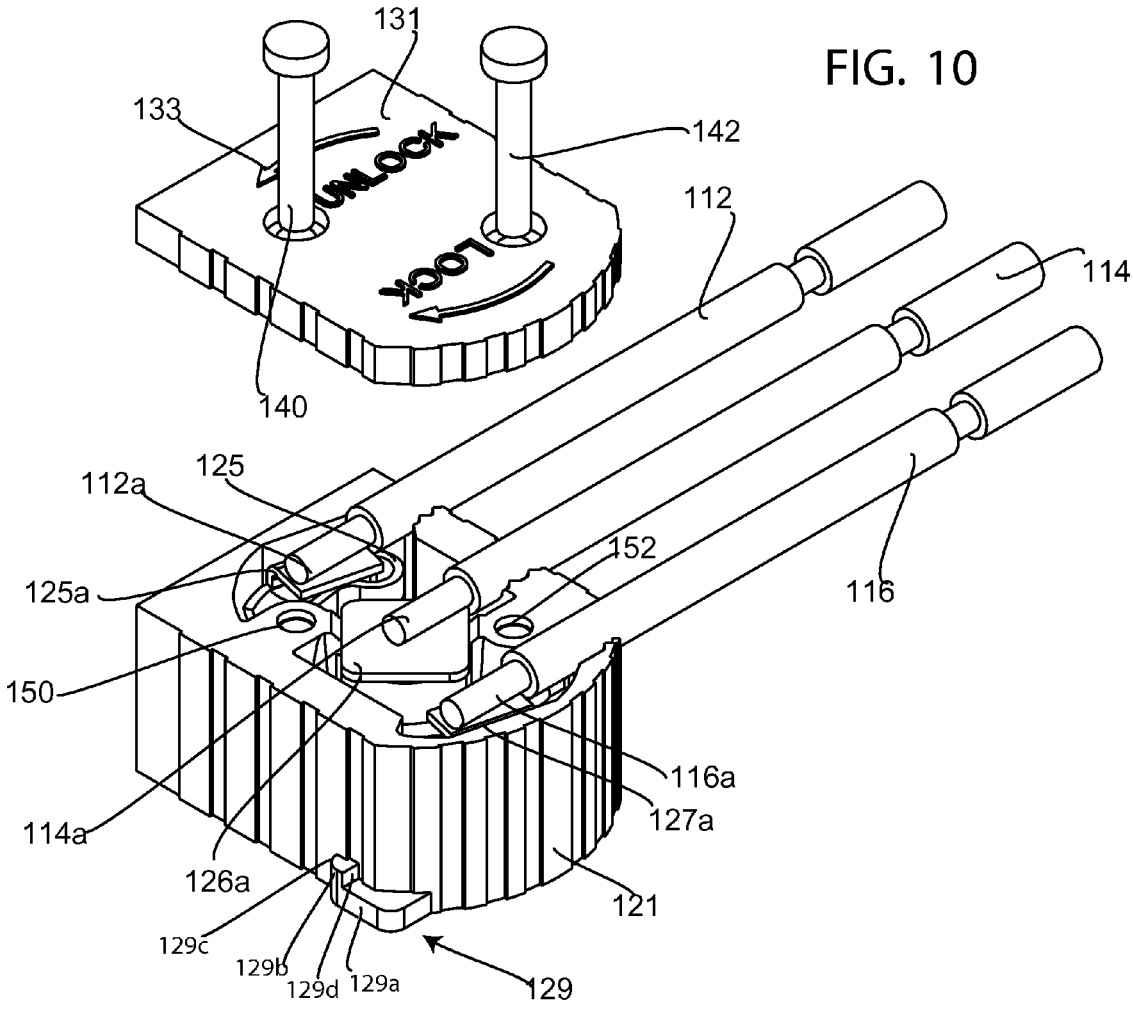
FIG. 10 is an open semi-exploded view of the wiring unit shown in FIG. 9.

FIG. 10 discloses the backside view of the embodiment shown in FIG. 9. In this view, there is shown wiring unit 120 which includes body section 121 and back plate 131 which is coupled to body section 121 via fasteners 140 and 142 which are insertable into holes 150 and 152 on body section 121. A plurality of wires 112, 114, and 116 having respective exposed ends 112*a*, 114*a*, and 116*a* are shown coupled to electrical contacts 125*a*, 126*a*, and 127*a* which lead to respective open contacts on the opposite face (See FIG. 9). Disposed on back face 131 can be writing or indicia 131 setting forth a set of instructions to a user on how to connect wiring unit 120 to functional unit 130.

When wiring unit 120 is coupled to functional unit 130, locking flanges 128 and 129 interact with locking flanges 182, 184, and 186 to form a secure connection. For example, as wiring module 120 is rotated in a clockwise manner, the leading edge 129*c* which is formed with a curved interface rotates into locking flange 186 formed as a leaf spring or latch release tab. This rotational movement drives locking flange 186 back and allows locking flange 129 underneath overhang 186*b*. In the fully rotated and locked position, locking projection 129*b* has rotated past locking flange 186 such that inside face 129*d* of locking projection 129*b* is now in contact with an inside face of locking flange 186. To unlock wiring unit or wiring module 120 from functional module 130, latch release tab or locking flange 186 is pulled back so that locking flange 129 can now pass underneath overhang 186*b* wherein as wiring module 120 continues to rotate past locking flange 186, it can then be moved into a release position so that it can be pulled away from functional module 130. Either of the wiring modules 20 or 120 may include additional labels including indicia, which can be used as instructions for connecting the wiring modules and the functional modules together. These labels can be coupled to a top section or a side surface of these wiring modules.

In addition, in each of the embodiments, the two wiring units 20 and 120 and the functional units 30 and 130 can each include rejection elements. These rejection elements can be in the form of flanges such as flanges 28 and 29, or curved connection bracket 84 and 184 which can operate as a rejection post which can be used to intersect with a perimeter of the bodies 19, and 119 of either of the wiring units 20, 120.

The designs of wiring modules 20, 120 and functional modules 30 and 130 are formed so that these devices can be both electrically and mechanically coupled together in a secure manner. In addition both of these embodiments are designed so that the wiring module and the functional module can only be coupled together in one way, so as to prevent against miswiring.

Figure 11:
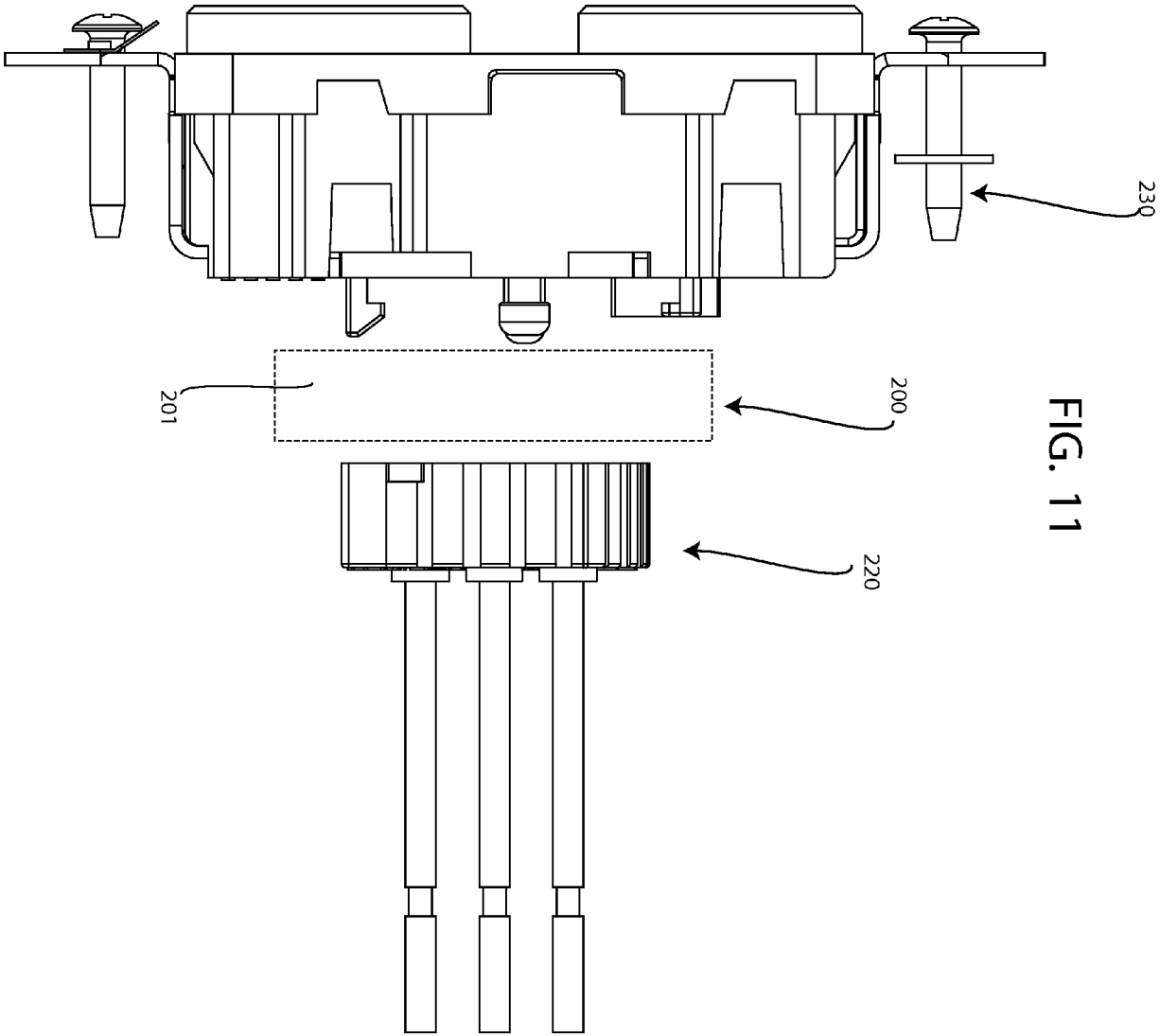
FIG. 11 is a side view of an adapter which is used to connect the functional unit with the wiring unit.

FIG. 11 is a side view of a modular wiring device which shows a functional unit 230 a wiring unit 220 and an adapter unit 200 disposed in between. This adapter unit 200 is designed to be a universal adapter to connect any wiring unit to any functional unit. Thus, the use of the adapter unit 200 allows for the connection of any type of wiring unit 220 to the functional unit 230. Adapter 200 is shown as a generic box because it can essentially be made so that it is connectable to any type of wiring unit 220 and any type of functional unit 230 as a connecting interface.

Figure 12:
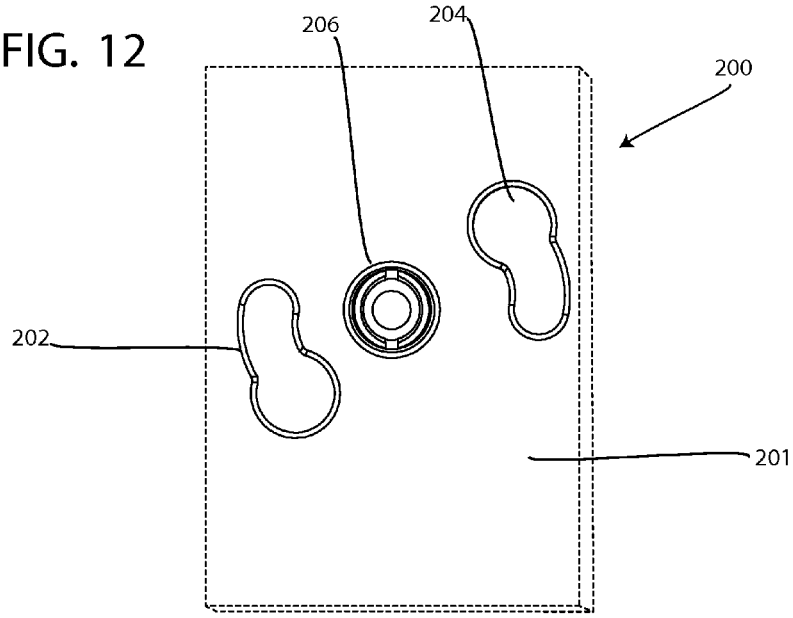
FIG. 12 is a front view of the adapter shown in FIG. 11.

One example of adapter 200 is shown in FIG. 12 which shows a front face of a body section 201 of adapter 200. This front face has holes 202, 204 and 206 for interfacing with connection elements such as prongs or connection interfaces 36, 37, and 38 (See FIG. 5B). Body section 201 is shown in dotted lines because it can be designed with any shape necessary to connect a functional unit to a wiring unit.

Figure 13:
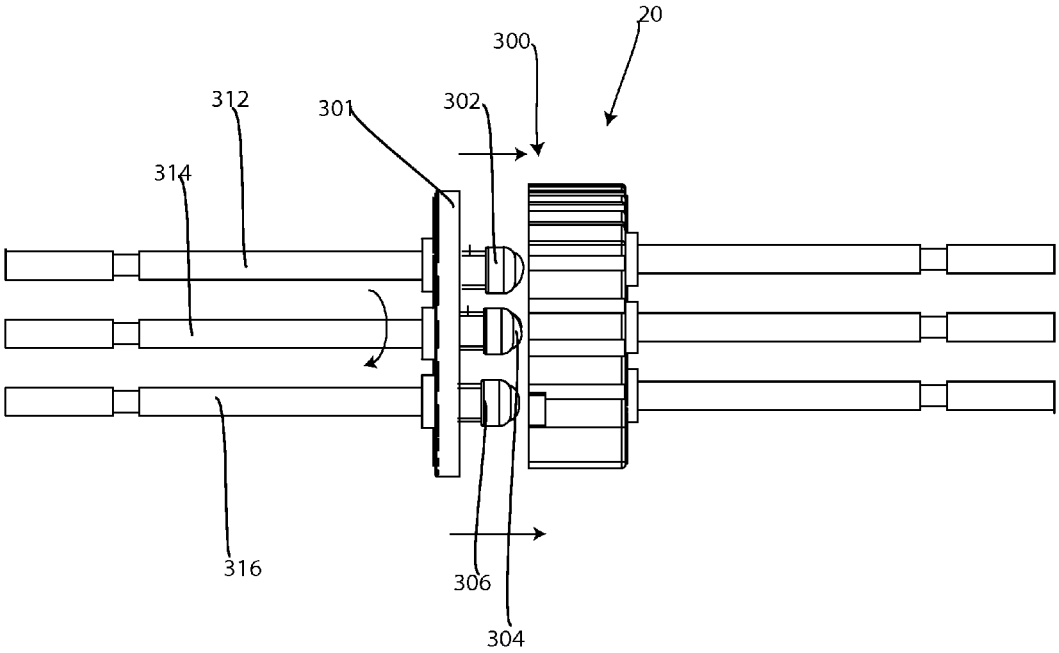
FIG. 13 is a side view of a connector which can be used to connect to a wiring unit.

FIG. 13 shows another connection element or adapter 300 which has a body section 301, and prongs 302, 304, and 306. Each of prongs 302, 304, and 306 are connected to respective wires 312, 314, and 316 wherein these wires form connection ends which can be crimped, screwed on, or attached by any known means to a functional unit, or any type of receptacle which is connectable to wires. Thus, with this type of adapter, the wiring unit can be connected either to an associated functional unit, or wired to any available receptacle.

Figure 14A:
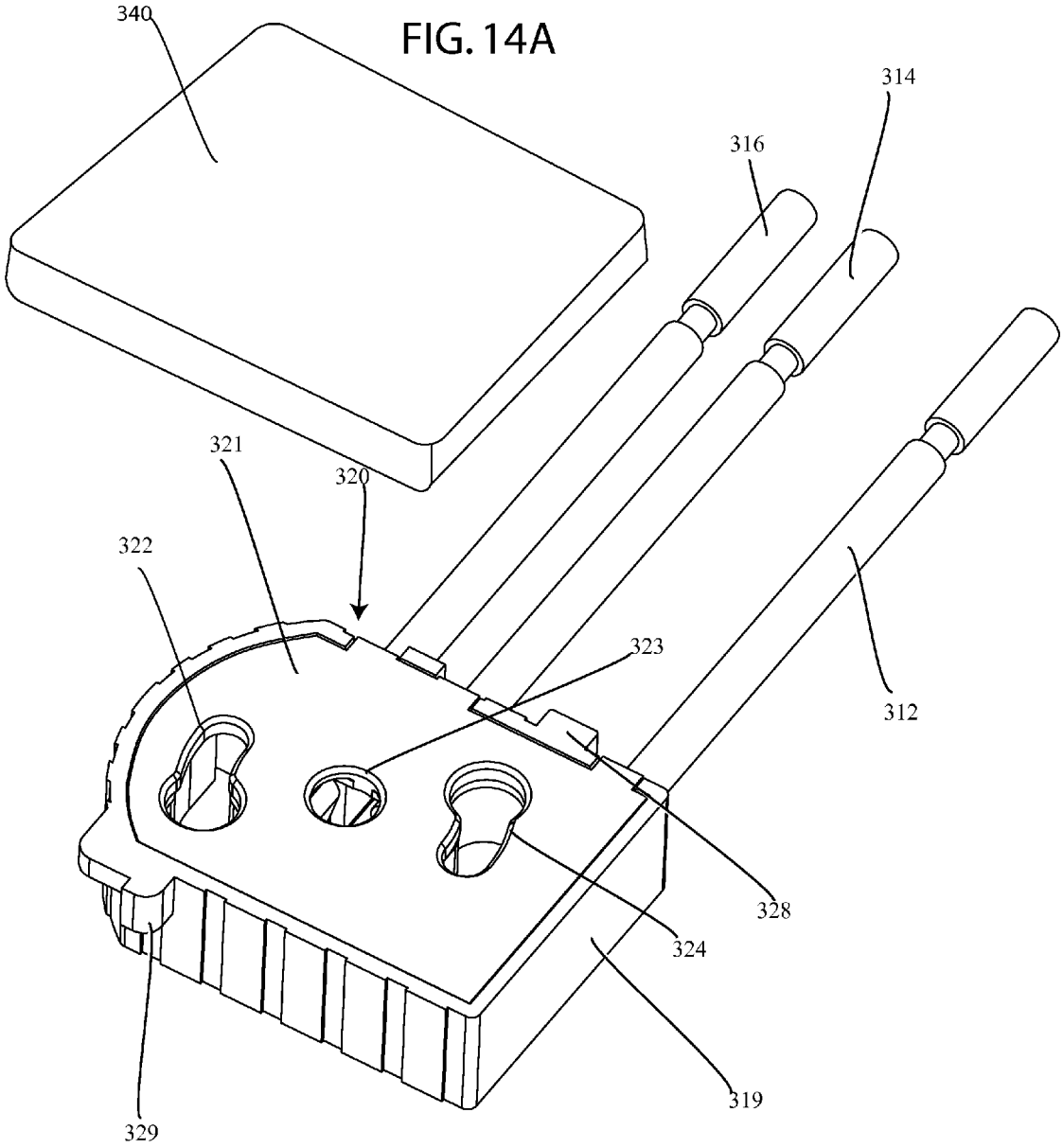
FIG. 14A is a top perspective view of another embodiment of a wiring unit.

FIG. 14A is a top perspective view of another embodiment of a wiring unit. With this embodiment, there is a wiring unit 320 which has a front face 321, with holes or openings 322, 323, and 324 for receiving prongs. Extending out from a housing 319 are wires 312, 314 and 316, wherein wire 314 is a ground wire while wires 312 and 316 are phase and neutral lines. There are also flanges 328 and 329 for locking with a corresponding functional unit. With this embodiment as well as with the embodiments shown with respect to wiring units 20 and 120, a cap 340 made from any suitable material such as plastic can be used to cover the front face of the wiring unit as well.

Figure 14B:
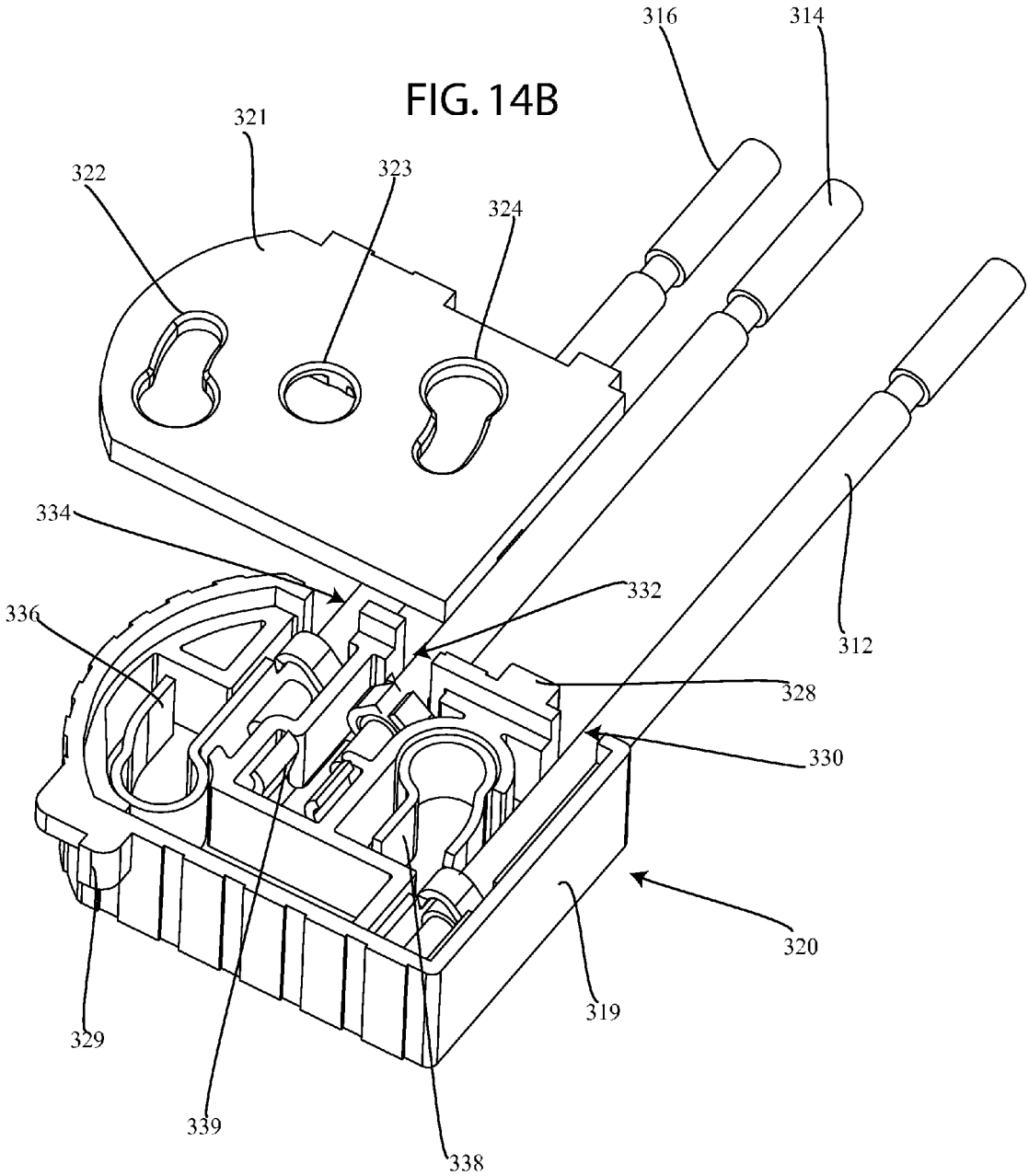
FIG. 14B is a top perspective partially exploded view of the wiring unit of FIG. 14A.

FIG. 14B is top partially exploded perspective view of the wiring unit shown in FIG. 14A. With this view, top 321 is removed from wiring unit 320 showing how wires 312, 314, and 316 enter through holes 330, 332, and 334 in housing 319. Holes 330, 332, and 334 are side entry holes which allow this design to be more compact, with the depth of housing 319 being more compact than the depth of housing 19 or 119. Contacts or terminals 336, 338, and 339 are disposed inside of housing 319 and are designed to receive associated prongs or terminal connections from a respective functional unit.

Figure 15A:
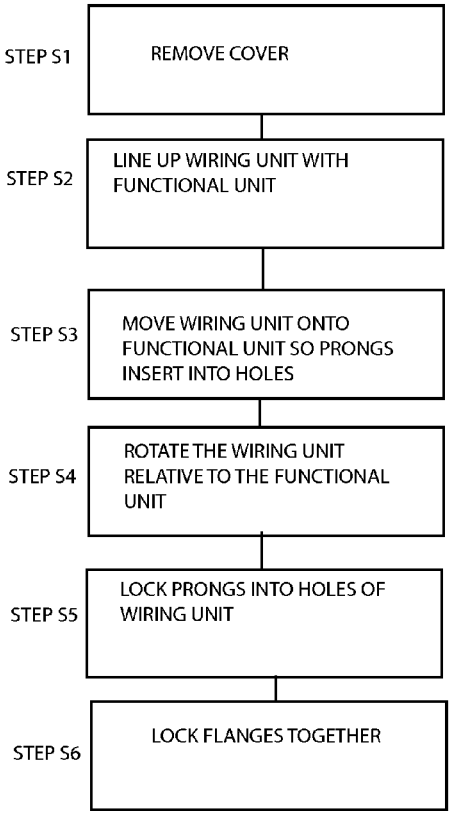
FIG. 15A is a flow chart for the process for connecting the wiring module to the functional module.
Figure 15B:
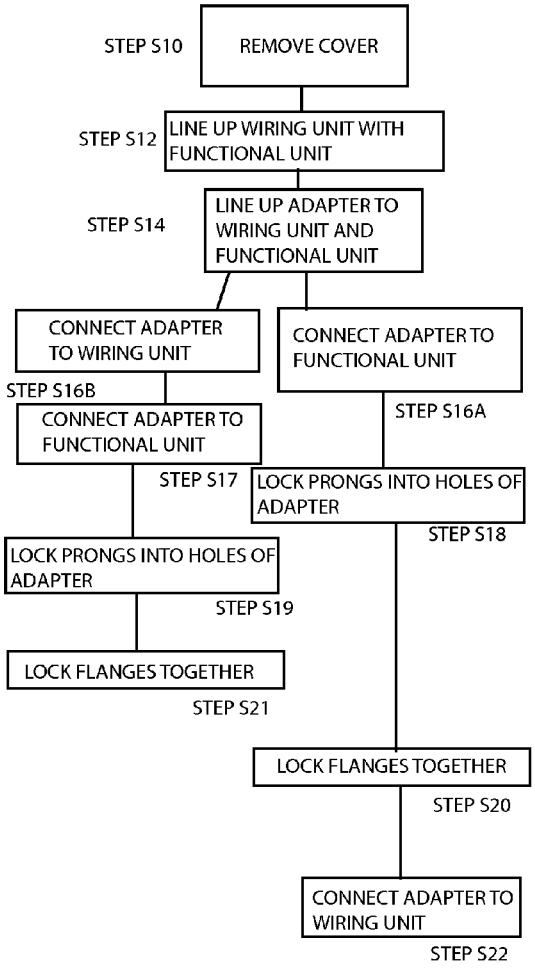
FIG. 15B is a flow chart for the process for connecting the wiring module and the functional module to the adapter.

FIG. 15A is a flow chart for a process for connecting the system including the wiring unit and the functional unit together, while FIG. 15B is a flow chart showing the process for connecting the wiring unit, the functional unit and the adapter together.

For example, FIG. 15A shows the process for connecting a wiring unit such as unit 20 or 120 to a functional unit such as unit 30 or 130 wherein if there is a cover, in step S1 a user can remove a cover from wiring unit 20 or 120. If there is no cover, then the first step is step S2. Next, in step S2 a user lines up a wiring unit with a functional unit, whereas in step S3 the user moves the wiring unit onto the functional unit so that prongs such as prongs 36, 37, and 38 or 136, 137 and 138 insert into corresponding holes 22, 23, and 24 or 122, 123, and 124. Next, in step S4 the wiring unit 20 or 120 and the functional unit 30 or 130 can be rotated relative to each other. This rotational movement can be performed by rotating both of the units, or by holding one of the units stationary while rotating one unit relative to the other unit. Next, in step S5 the prongs are locked into the associated holes wherein the flanges such as flanges 28 and 29 or 128 and 129 are locked into corresponding flanges 82, and 86 to lock the wiring unit together with the functional unit. In this way, the rotation of wiring unit 20 is such that the larger ends of prongs 36, and 38 lock into the smaller hole openings on the wiring unit, while flanges 28 and 29 or 128 and 129 lock under and into flanges 82 and 86.

FIG. 15B shows a flow chart for the process for connecting the wiring unit, the functional unit and the adapter together. With this process, if there is a cover, a user can in step S10 remove a cover as that shown in FIG. 4B. Next, in step S12, and step S14 which can occur in any order, a user lines up a wiring unit with the functional unit (step S12) and also lines up the adapter with the wiring unit and the functional unit in step S14. Next, in step S16A the adapter can be connected to the functional unit. In step S18 the prongs of the functional unit can be locked into the holes of the adapter so as to secure the adapter 200 to the functional unit. In step S20, which can occur simultaneous with the connection of the prongs, the flanges of the functional unit are connected to the adapter. Finally, in step S22 the adapter is connected to the wiring unit so that there is full electrical continuity between the wiring unit and the functional unit.

Alternatively, in step 16B, the adapter can be connected to the wiring unit. Next, in step S17, the adapter is connected to the functional unit by inserting the prongs into the holes of the adapter. Next in step S19 and in step S21 which can occur sequentially in any order or simultaneously, the prongs are locked into the holes of the adapter while the flanges on the functional unit are locked into the flanges on the adapter. While the different sequential steps are shown in FIGS. 15A and 15B, these steps can be simplified as well. For example, the step series of FIG. 15A can be simply a single step of connecting a functional unit to a wiring unit. While the step series in FIG. 15B can be two different alternative steps such as connecting a wiring unit to an adapter and then the adapter to a functional unit, or connecting a functional unit to an adapter and then the adapter to the wiring unit. These steps can occur in any order or even substantially simultaneously.

As described above, the adapter is designed to bridge the different designs between any known functional unit and any known wiring unit so that any type of wiring unit can be connected to any type of functional unit.

Accordingly, while at least one embodiment of the present invention has been shown and described, it is to be understood that many changes and modifications may be made thereunto without departing from the spirit and scope of the invention as defined in the appended claims.

What is claimed is:

1. A wiring system comprising:

a) a functional unit configured to engage a wall box, said functional unit comprising a housing having a plurality of conductive elements extending therefrom;

b) a wiring unit configured to be located in said wall box, the wiring unit comprising:

i) a housing having a front face configured to contact said functional unit, a back face opposite said front face, a perimeter region extending between said front face and said back face and a plurality of conductive elements located therein and a plurality of openings formed in the front face thereof so that the plurality of conductive elements extending from the functional unit housing can be inserted into said wiring unit housing and into contact with the plurality of conductive elements located in said wiring unit housing when said wiring unit is coupled to said functional unit;

ii) plurality of wires extending from said wiring unit housing, each of the wires being connectable to one of the conductive elements in said wiring unit housing and to a power distribution network; and iii) at least one flange coupled to said wiring unit housing and extending out from said perimeter region to an exterior region of said wiring unit housing, said at least one flange being adapted to inhibit the disconnection of the wiring unit from said functional unit after the wiring unit is rotated into a connected position.

2. The system as in claim 1, wherein at least one of said plurality of openings has at least one receiving region and at least one locking region, wherein said functional unit comprises a front face and a back face, wherein said wiring unit is configured to connect to said back face of said functional unit.

3. The system as in claim 1, further comprising at least one removable cover coupled to said front face of said wiring unit.

4. The system as in claim 3, wherein said removable cover is at least one of a label and a cap.

5. The system as in claim 3, wherein said at least one functional unit comprises a strap.

6. The system as in claim 2, wherein said removable cover has a write-on surface.

7. A wiring system comprising:

a) a functional unit including a strap configured to allow said functional unit to engage a wall box, the functional unit including a housing and at least one prong extending therefrom;

b) a wiring unit configured to be rotatively coupled to the functional unit, the wiring unit comprising:

i) a housing having a front face, a back face, a perimeter region extending between said front and back faces, at least one opening and at least one conductive element, the at least one opening being configured to receive the at least one prong of said functional unit when the wiring unit is coupled to said functional unit;

ii) at least one wire extending from said wiring unit housing, said at least one wire connecting the conductive element to a power distribution network for providing power from the power distribution network; and iii) at least one connection element comprising a flange disposed on said wiring unit housing, and being adapted to inhibit the disconnection of said wiring unit from said functional unit.

8. The system as in claim 7, wherein said flange comprises a curved leading edge.

9. The system as in claim 8, wherein said curved leading edge of said flange is formed as a rounded corner on said flange, and wherein said functional unit comprises a flange, such that when said flange on the wiring unit contacts said flange on the functional unit during rotation, said curved leading edge allows said wiring unit to continue to rotate.

10. A method for connecting a functional electrical module to a power distribution network comprising the steps of:

a) electrically coupling a wiring unit to the power distribution network;

b) positioning a plurality of electrical contacts of a functional unit into contact with a wiring unit having a housing having a plurality of openings, a plurality of electrical contacts, and a flange, wherein said plurality of openings on said wiring unit housing is configured to receive said plurality of electrical contacts of said functional unit, the functional unit including a flange;

c) rotating said wiring unit from a first position to a second position;

d) coupling said wiring unit flange extending out from an exterior surface of a perimeter region of said wiring unit housing, to said functional unit flange, to secure said wiring unit to said functional unit and to inhibit the disconnection of the wiring unit from said functional unit wherein said perimeter region of said wiring unit extends along a substantial portion of said wiring unit housing; and e) installing said functional unit into a wall box.

11. The method as in claim 10, wherein said functional unit has a functional element that is selected from the group consisting of: a switch, a receptacle, a ground fault circuit interrupter, a dimmer, an occupancy sensor, a remote control, a home security control, and a surge protector.

12. The system as in claim 1, wherein said wiring unit housing comprises at least two flanges, wherein said at least two flanges comprise a first flange extending out from an exterior region of said wiring unit housing, and a second oppositely spaced flange extending out from an exterior region of said wiring unit housing, wherein said functional unit comprises at least two flanges, wherein when said wiring unit is coupled to said functional unit and rotated, said at least two flanges of said wiring unit are coupled to at least two corresponding flanges of said functional unit.

13. The system as in claim 7, wherein said wiring unit housing comprises at least two flanges, wherein said at least two flanges comprise a first flange extending out from an exterior region of said wiring unit housing, and a second oppositely spaced flange extending out from an exterior region of said wiring unit housing, and wherein said functional unit comprises at least two flanges, wherein when the wiring unit is coupled to said functional unit and rotated, said at least two flanges of said wiring unit are coupled to at least two corresponding flanges of said functional unit.

14. The method as in claim 10, wherein said wiring unit housing comprises at least two flanges, wherein said at least two flanges comprise a first flange extending out from an exterior region of said wiring unit housing, and a second oppositely spaced flange extending out from an exterior region of said wiring unit housing, and wherein said functional unit comprises at least two flanges, wherein when the wiring unit is coupled to said functional unit and rotated, said at least two flanges of said wiring unit are coupled to at least two corresponding flanges of said functional unit.

15. The system as in claim 1, further comprising at least one central conductive element disposed in said wiring unit housing and wherein said functional unit further comprises a ground prong, said central conductive element being configured to receive said ground prong from said functional unit.

16. The system as in claim 7, at least one central conductive element disposed in said wiring unit housing and wherein said functional unit further comprises a ground prong, said central conductive element being configured to receive said ground prong from said functional unit.

17. The method as in claim 10, further comprising at least one central shaft disposed in said wiring unit housing, and wherein said functional unit further comprises a ground prong, said central conductive element being configured to receive said ground prong from said functional unit.

18. The system as in claim 15, further comprising at least one ground wire, wherein said central conductive element is coupled to said ground wire.

19. The system as in claim 15, further comprising at least one ground wire, wherein said central conductive element is coupled to said ground wire.

20. The method as in claim 17, further comprising at least one ground wire, wherein said central conductive element is coupled to said ground wire.

* * * * *